US008063344B2

(12) United States Patent
Cole et al.

(10) Patent No.: US 8,063,344 B2
(45) Date of Patent: Nov. 22, 2011

(54) MICROWAVE ENERGY INTERACTIVE FOOD PACKAGE

(75) Inventors: Lorin R. Cole, Larsen, WI (US); Daniel J. Keefe, Cincinnati, OH (US); Laurence M. C. Lai, Mississauga (CA); Bing Liu, Mississauga (CA)

(73) Assignee: Graphic Packaging International, Inc., Marietta, GA (US)

( * ) Notice: Subject to any disclaimer, the term of this patent is extended or adjusted under 35 U.S.C. 154(b) by 1246 days.

(21) Appl. No.: 11/789,349

(22) Filed: Apr. 24, 2007

(65) Prior Publication Data

US 2007/0251942 A1 Nov. 1, 2007

Related U.S. Application Data

(60) Provisional application No. 60/795,325, filed on Apr. 27, 2006.

(51) Int. Cl.
*H05B 6/80* (2006.01)

(52) U.S. Cl. ..... 219/730; 219/728

(58) Field of Classification Search ..... 219/730, 219/728, 759; 426/107, 109, 111, 113, 241, 426/243, 234; 99/DIG. 14
See application file for complete search history.

(56) References Cited

U.S. PATENT DOCUMENTS

| | | | | |
|---|---|---|---|---|
| 4,592,914 | A * | 6/1986 | Kuchenbecker | 426/107 |
| 4,775,771 | A | 10/1988 | Pawlowski | |
| 4,794,005 | A * | 12/1988 | Swiontek | 426/107 |
| 4,865,921 | A | 9/1989 | Hollenberg | |
| 4,890,439 | A | 1/1990 | Smart | |
| 4,936,935 | A | 6/1990 | Beckett | |
| 4,963,424 | A | 10/1990 | Beckett | |
| 5,039,364 | A | 8/1991 | Beckett et al. | |
| 5,117,078 | A | 5/1992 | Beckett | |
| 5,124,519 | A * | 6/1992 | Roy et al. | 219/759 |
| 5,213,902 | A | 5/1993 | Beckett | |
| 5,221,419 | A | 6/1993 | Beckett | |
| 5,260,537 | A | 11/1993 | Beckett | |
| 5,266,386 | A | 11/1993 | Beckett | |
| RE34,683 | E | 8/1994 | Maynard | |
| 5,340,436 | A | 8/1994 | Beckett | |
| 5,354,973 | A | 10/1994 | Beckett | |
| 5,405,663 | A * | 4/1995 | Archibald et al. | 428/34.3 |
| 5,410,135 | A | 4/1995 | Pollart | |
| 5,424,517 | A | 6/1995 | Habeger | |
| 5,519,195 | A | 5/1996 | Keefer | |

(Continued)

FOREIGN PATENT DOCUMENTS

EP 0 790 123 A2 8/1997

(Continued)

OTHER PUBLICATIONS

Partial European Search Report, EP Application No. 10006269, mailed Aug. 9, 2010.

(Continued)

*Primary Examiner* — Quang Van
(74) *Attorney, Agent, or Firm* — Womble Carlyle Sandridge & Rice, LLP

(57) ABSTRACT

A microwave heating package includes a dimensionally stable first component for supporting a food item and a flexible second component dimensioned to receive the dimensionally stable first component. Each of the first component and the second component may include a microwave energy interactive element for altering the effect of microwave energy on a food item within the package.

38 Claims, 24 Drawing Sheets

U.S. PATENT DOCUMENTS

| | | | | |
|---|---|---|---|---|
| 5,628,921 | A | 5/1997 | Beckett | |
| 5,672,407 | A | 9/1997 | Beckett | |
| 5,759,422 | A | 6/1998 | Schmelzer | |
| 5,800,724 | A | 9/1998 | Habeger | |
| 6,114,679 | A | 9/2000 | Lai | |
| 6,150,646 | A | 11/2000 | Lai | |
| 6,204,492 | B1 | 3/2001 | Zeng | |
| 6,251,451 | B1 | 6/2001 | Zeng | |
| 6,414,290 | B1 | 7/2002 | Cole | |
| 6,433,322 | B2 | 8/2002 | Zeng | |
| 6,455,827 | B2 | 9/2002 | Zeng | |
| 6,552,315 | B2 | 4/2003 | Zeng | |
| 6,677,563 | B2 | 1/2004 | Lai | |
| 6,717,121 | B2 | 4/2004 | Zeng | |
| 6,765,182 | B2 | 7/2004 | Cole | |
| 7,019,217 | B2 | 3/2006 | Bryant | |
| 2001/0017297 | A1* | 8/2001 | Zeng et al. | 219/730 |
| 2003/0141218 | A1 | 7/2003 | Stephens et al. | |
| 2005/0173425 | A1 | 8/2005 | Wnek et al. | |
| 2005/0184066 | A1 | 8/2005 | Brooks et al. | |
| 2005/0205565 | A1 | 9/2005 | Cole et al. | |
| 2005/0230384 | A1 | 10/2005 | Robison et al. | |
| 2006/0049190 | A1 | 3/2006 | Middleton | |
| 2006/0113300 | A1 | 6/2006 | Wnek | |
| 2006/0278521 | A1 | 12/2006 | Stowell | |

FOREIGN PATENT DOCUMENTS

| | | | |
|---|---|---|---|
| EP | 1 481 922 | A2 | 12/2004 |
| GB | 2 365 000 | A | 2/2002 |
| GB | 2 413 750 | A | 11/2005 |
| JP | 63-84337 | | 6/1988 |
| JP | 02-215337 | | 8/1990 |
| JP | 09-040031 | | 2/1997 |
| JP | 2005-516853 | | 6/2005 |
| WO | WO 01/22778 | A1 | 3/2001 |
| WO | WO 02/40374 | A1 | 5/2002 |
| WO | WO 03/066435 | A2 | 8/2003 |
| WO | WO 2005/068321 | A2 | 7/2005 |

OTHER PUBLICATIONS

U.S. Appl. No. 11/673,136, filed Feb. 9, 2007, Middleton.

Notification of Reason for Refusal for JP 2009-507773 dated Jun. 20, 2011, and English translation.

* cited by examiner

MICROWAVE ENERGY INTERACTIVE FOOD PACKAGE

CROSS-REFERENCE TO RELATED APPLICATION

This application claims the benefit of U.S. Provisional Application No. 60/795,325, filed Apr. 27, 2006, which is incorporated by reference herein in its entirety.

TECHNICAL FIELD

The present invention relates to a various packages and constructs for heating, browning, and/or crisping a food item, and particularly relates to various packages and constructs for heating, browning, and/or crisping a food item in a microwave oven.

BACKGROUND

Microwave ovens have become a principle form of heating food in a rapid and effective manner. Various attempts have been made to provide microwave food packages that produce effects associated with foods cooked in a conventional oven. Such packages must be capable of controlling the distribution of energy around the food item, utilizing the energy in the most efficient manner, and ensuring that the food item and the container provide a pleasant and acceptable finished food item. While some microwave interactive packages are available commercially, there remains a need for improved materials and constructs that provide the desired level of heating, browning, and/or crisping of a food item in a microwave oven.

SUMMARY

The present invention is directed generally to various packages or packaging systems for heating a food item in a microwave oven, blanks for forming such packages, and methods of making and using such packages. The various packages include one or more components, for example, cards, trays, platforms, sleeves, pouches, wrappers, or other constructs (collectively "constructs") configured to provide enhanced heating, browning, and/or crisping of a food item in a microwave oven.

In one aspect, the various packages include a first, dimensionally stable, at least partially semi-rigid or rigid construct or component capable of or operative for supporting or containing a food item, and a second, at least partially flexible construct or component dimensioned to receive the first construct. In another aspect, at least one of the first construct and the second construct includes at least one microwave energy interactive element that alters the effect of microwave energy on an adjacent food item by absorbing microwave energy, transmitting microwave energy, reflecting microwave energy, or directing microwave energy. In still another aspect, two or more of such microwave energy interactive elements are superposed, thereby providing an enhanced interaction in that area of the package and an enhanced effect on an adjacent food item. Any combination of constructs and microwave energy interactive elements may be used, as needed or desired for a particular application.

For example, in one particular aspect, the package includes a dimensionally stable first component for supporting a food item and a flexible second component dimensioned to receive the dimensionally stable first component. The dimensionally stable first component includes a first microwave energy interactive element and the flexible second component includes a second microwave energy interactive element.

In any of the numerous packages contemplated hereby, first component may be joined fixedly to, joined removably to, or may be separate from the second component. If desired, the first component may support or contain a food item during heating, and also serve as a container to hold the food item as it is being transported and/or consumed by the user. Thus, the package may be used to store the food item prior to heating in a microwave oven, may be used to enhance the heating, browning, and/or crisping of the food item, and/or may be used to transport the food item for convenient "on the go" consumption of the food item.

In one variation, the dimensionally stable first component comprises a card, a tray, a platform, a sleeve, or any combination thereof and the first microwave energy interactive element comprises a susceptor, a segmented metal foil, or any combination thereof.

In another variation, the dimensionally stable first component comprises a substantially planar card and the first microwave energy interactive element comprises a susceptor, a segmented metal foil, or any combination thereof overlying at least a portion of the card.

In yet another variation, the dimensionally stable first component comprises a tray including a base and a plurality of upstanding walls, and the first microwave energy interactive element comprises a susceptor, a segmented metal foil, or any combination thereof overlying at least a portion of the base.

In still another variation, the dimensionally stable first component comprises a platform including a base and a pair of opposed, upstanding walls, and the first microwave energy interactive element overlies at least a portion of the base. In one example, the first microwave energy interactive element further overlies at least a portion of the pair of opposed, upstanding walls. In another example, the first microwave energy interactive element comprises a susceptor, and the microwave heating package further comprises a segmented metal foil overlying at least a portion of the base. In still another example, the first microwave energy interactive element further overlies at least a portion of the pair of opposed, upstanding walls, the first microwave energy interactive element comprises a susceptor, and the microwave heating package further comprises a segmented metal foil superposed with at least a portion of the susceptor overlying the base.

In yet another variation, the dimensionally stable first component comprises a sleeve including a pair of opposed major panels, each having a longitudinal dimension extending in a longitudinal direction and a transverse dimension extending in a transverse direction, and a pair of opposed minor panels joined to the major panels along lines of disruption extending in the longitudinal direction, each minor panel having a longitudinal dimension extending in the longitudinal direction and a transverse dimension extending in the transverse direction. The pair of opposed major panels and the pair of opposed minor panels define an interior surface of the microwave heating package. The first microwave energy interactive element overlies at least a portion of the interior surface. In one example, the sleeve further includes a tear line extending in the transverse direction across each of the opposed major panels and the opposed minor panels. The tear line may substantially bisect the sleeve in the longitudinal direction. In another example, the sleeve further includes a plurality of support elements extending from the minor panels. Each of the support elements may be defined by a slit, for example, an arcuate slit, that initiates and terminates along one of the lines of disruption extending in the longitudinal direction. In another example, the first microwave energy interactive element comprises a susceptor. In yet another example, a segmented metal foil is superposed with at least a portion of the susceptor overlying one of the major panels.

In another variation, the flexible second component comprises a pouch, a wrapper, or any combination thereof and the second microwave energy interactive element comprises a susceptor. The susceptor may be substantially continuous or may include one or more apertures or discontinuities. In one example, the susceptor has a grid pattern.

In another variation, the flexible second component comprises a microwave energy interactive insulating material and the microwave energy interactive insulating material includes the second microwave energy interactive element. The microwave energy interactive insulating material may include a susceptor film comprising a layer of microwave energy interactive material supported on a first polymer film, a moisture-containing layer superposed with the layer of microwave energy interactive material, and a second polymer film joined to the moisture-containing layer in a predetermined pattern, thereby forming a plurality of expandable insulating cells between the moisture-containing layer and the second polymer film. The moisture-containing layer is positioned between the microwave energy interactive material and the second polymer film. The layer of microwave energy interactive material is the second microwave energy interactive element. The moisture-containing layer releases water vapor when the microwave heating package is exposed to microwave energy. As a result, at least some of the expandable insulating cells inflate when the microwave heating package is exposed to microwave energy.

In another particular aspect, a microwave heating package comprises a flexible component including at least a first panel and a second panel in an opposed relation with a cavity therebetween, and a dimensionally stable component sized to be received with the cavity and seated on the first panel. A microwave energy interactive material overlies at least a portion of the second panel and at least a portion of the dimensionally stable component.

In one variation, the dimensionally stable component includes a surface for supporting a food item having a bottom surface and a top surface, each intended to be browned and/or crisped, and the microwave energy interactive material overlying at least a portion of the dimensionally stable component promotes browning and/or crisping of the bottom surface of the food item. In one example, the microwave energy interactive material may further overlies at least a portion of the first panel of the flexible component, and the microwave energy interactive material overlying at least a portion of the first panel promotes further browning and/or crisping of the bottom surface of the food item. In another example, the microwave energy interactive material overlying at least a portion of the second panel of the flexible component promotes browning and/or crisping of the top surface of the food item. In still another example, the food item further has at least one side surface intended to be browned and/or crisped, the flexible component further includes a pair of opposed side panels joined to the first panel and the second panel to define the cavity, and the microwave energy interactive material further overlies at least a portion of each of the side panels. In yet another example, the food item further has a plurality of side surfaces intended to be browned and/or crisped, the dimensionally stable component includes a base and a pair of upstanding walls, and the microwave energy interactive material further overlies at least a portion of each of the upstanding walls.

In another aspect, a blank for forming a dimensionally stable construct for heating a food item in a microwave oven, comprises a base panel, a pair of opposed side panels joined to the base panel along respective lines of disruption, and a susceptor overlying at least a portion of the base panel and side panels. In one variation, a plurality of cut lines initiate and terminate along the lines of disruption. In another variation, a segmented metal foil overlies at least a portion of the base panel.

In still another aspect, a blank for forming a dimensionally stable construct for heating a food item in a microwave oven comprises a first panel having a longitudinal dimension extending in a longitudinal direction and a transverse dimension extending in a transverse direction. The first panel includes a first segment and a second segment joined along a transverse tear line. The blank also includes a pair of opposed side panels joined to the first panel along respective longitudinal fold lines. The side panels each includes a transverse tear line substantially aligned with the transverse tear line in the first panel. A pair of opposed end panels are joined to the side panels along respective longitudinal fold lines. The side panels each include a transverse tear line substantially aligned with the transverse tear lines in the first panel and the side panels. A microwave energy interactive element overlies at least one of the first panel, the side panels, and the end panels.

In one variation, a plurality of cut lines initiates and terminates along the longitudinal fold line joining each side panel to the respective end panel. In another variation, a glue flap extends from at least one of the opposed end panels. In yet another variation, at least one aperture extends though at least one of the side panels. In still another variation, each of the opposed side panels includes a longitudinal fold line substantially centered in the transverse direction. In another variation, the first segment and second segment are each substantially octagonal in shape.

Additional aspects, features, and advantages of the present invention will become apparent from the following description and accompanying figures.

BRIEF DESCRIPTION OF THE DRAWINGS

The description refers to the accompanying drawings, in which like reference characters refer to like parts throughout the several views, and in which.

DESCRIPTION

The present invention is directed generally to a package for heating, browning, and/or crisping a food item in a microwave oven. The package generally includes a first component comprising a semi-rigid, dimensionally stable card, tray, or sleeve for supporting a food item thereon, and a second component comprising a pouch or wrapper dimensioned to receive the card, tray, or sleeve.

Either or both of the first component and the second component may include one or more microwave energy interactive elements. The various microwave energy interactive elements (hereinafter sometimes referred to as "microwave interactive elements") may promote browning and/or crisping of a particular area of the food item, shield a particular area of the food item from microwave energy to prevent overcooking thereof, and/or transmit microwave energy towards or away from a particular area of the food item. Each microwave energy interactive element comprises one or more microwave energy interactive materials or segments arranged in a particular configuration to absorb microwave energy, transmit microwave energy, reflect microwave energy, or direct microwave energy, as needed or desired for a particular microwave heating package and food item. The first component and the second component work in concert to enhance the heating, browning, and/or crisping of the food item.

Various aspects of the invention may be illustrated by referring to the figures. For purposes of simplicity, like numerals may be used to describe like features. It will be understood that where a plurality of similar features are depicted, not all of such features are necessarily labeled on each figure. While various examples are shown and described in detail herein, it also will be understood that any of the various features may be used with any package described herein or contemplated hereby, in any combination.

Figure 1A:
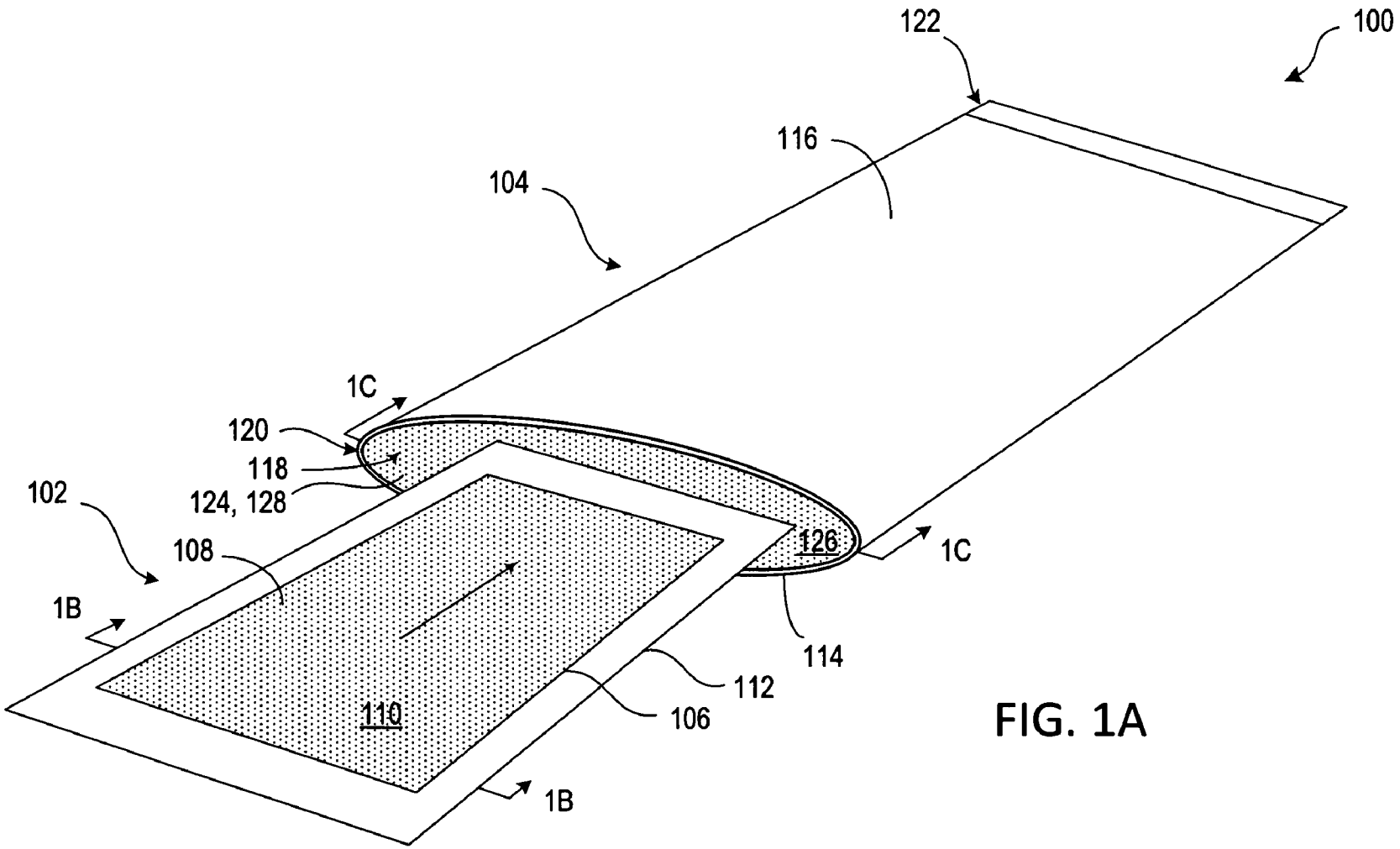
FIG. 1A schematically depicts an exemplary package according to various aspects of the present invention, including a microwave energy interactive card and a microwave energy interactive pouch.

FIG. 1A illustrates an exemplary package 100 according to various aspects of the invention. The package 100 includes a first component comprising a dimensionally stable, substantially planar card 102 for supporting a food item (not shown) thereon and a second component comprising a pouch 104 for receiving the food item and card 102. The card 102 is generally rectangular in shape, suitable for receiving an elongate food item, for example, a French bread pizza or sandwich thereon. However, it will be understood that the card may have any geometry, as needed or desired for a particular application. For example, the card may be circular, oval, square, triangular, pentagonal, or hexagonal in shape, or may be irregular in shape, with one or more symmetrical or unsymmetrical portions.

Figure 1B:
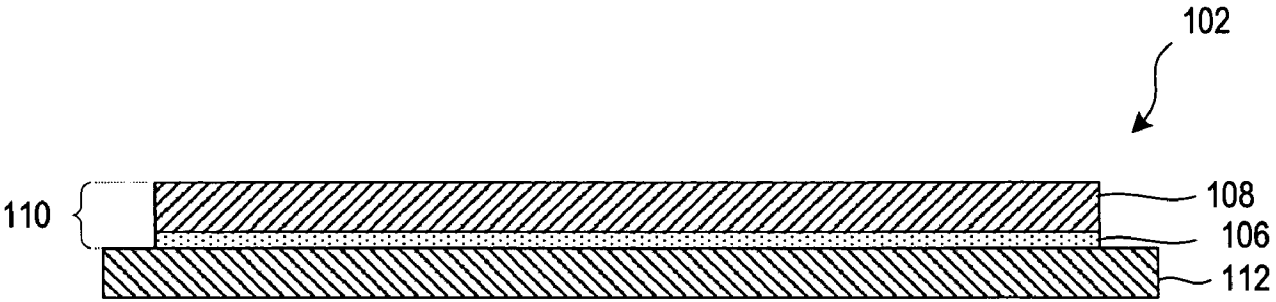
FIG. 1B is a schematic cross-sectional view of the microwave energy interactive card of FIG. 1A, taken along a line 1B-1B.

As shown in FIGS. 1A and 1B, a microwave energy interactive element 106 (schematically shown by stippling), for example, a susceptor, overlies a portion of the card 102. The susceptor 106 comprises a thin layer of microwave energy interactive material that tends to absorb microwave energy to and convert it to thermal energy or heat. Such elements often are used to promote browning and/or crisping of the surface of an adjacent food item (not shown).

A polymer film 108 overlies the susceptor 106 and at least a portion of the card 102 and defines at least a portion of a food-contacting or food-supporting surface 110. If desired, the susceptor 106 may be supported on the polymer film 108, in which case the susceptor 106 and film 108 may be referred to collectively as a "susceptor film" 110. Alternatively, the susceptor may be supported on any other suitable microwave energy transparent substrate, for example, paper.

In this and other aspects, embodiments, and examples of the invention, the microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

As stated above, any of the microwave energy interactive elements used in accordance with the invention may be supported on a substrate. The substrate typically comprises an electrical insulator, for example, a film formed from a polymer or polymeric material. As used herein the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, commercially available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) as measuring using ASTM F1249 of less than about 100 $g/m^2/day$. In one aspect, the barrier film has WVTR of less than about 50 g/m$^2$/day. In another aspect, the barrier film has a WVTR of less than about 15 g/m$^2$/day. In yet another aspect, the barrier film has a WVTR of less than about 1 g/m$^2$/day. In still another aspect, the barrier film has a WVTR of less than about 0.1 g/m$^2$/day. In a still further aspect, the barrier film has a WVTR of less than about 0.05 g/m$^2$/day.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,865,921; 4,775,771; and Re. 34,683, each of which is incorporated by reference herein in its entirety. Although particular examples of patterns of microwave energy interactive material are shown and described herein, it should be understood that other patterns of microwave energy interactive material are contemplated by the present invention.

Still viewing FIGS. 1A and 1B, the susceptor film 110 is joined at least partially to at least a portion of a dimensionally stable, microwave energy transparent support 112 (hereinafter referred to as "microwave transparent support", "microwave inactive support" or "support") to form the card 102.

If desired, all or a portion of the support may be formed at least partially from a paperboard material, which may be cut into a blank prior to use in the package. For example, the support may be formed from paperboard having a basis weight of from about 60 to about 330 lbs/ream (lb/3000 sq. ft.), for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

Figure 4A:
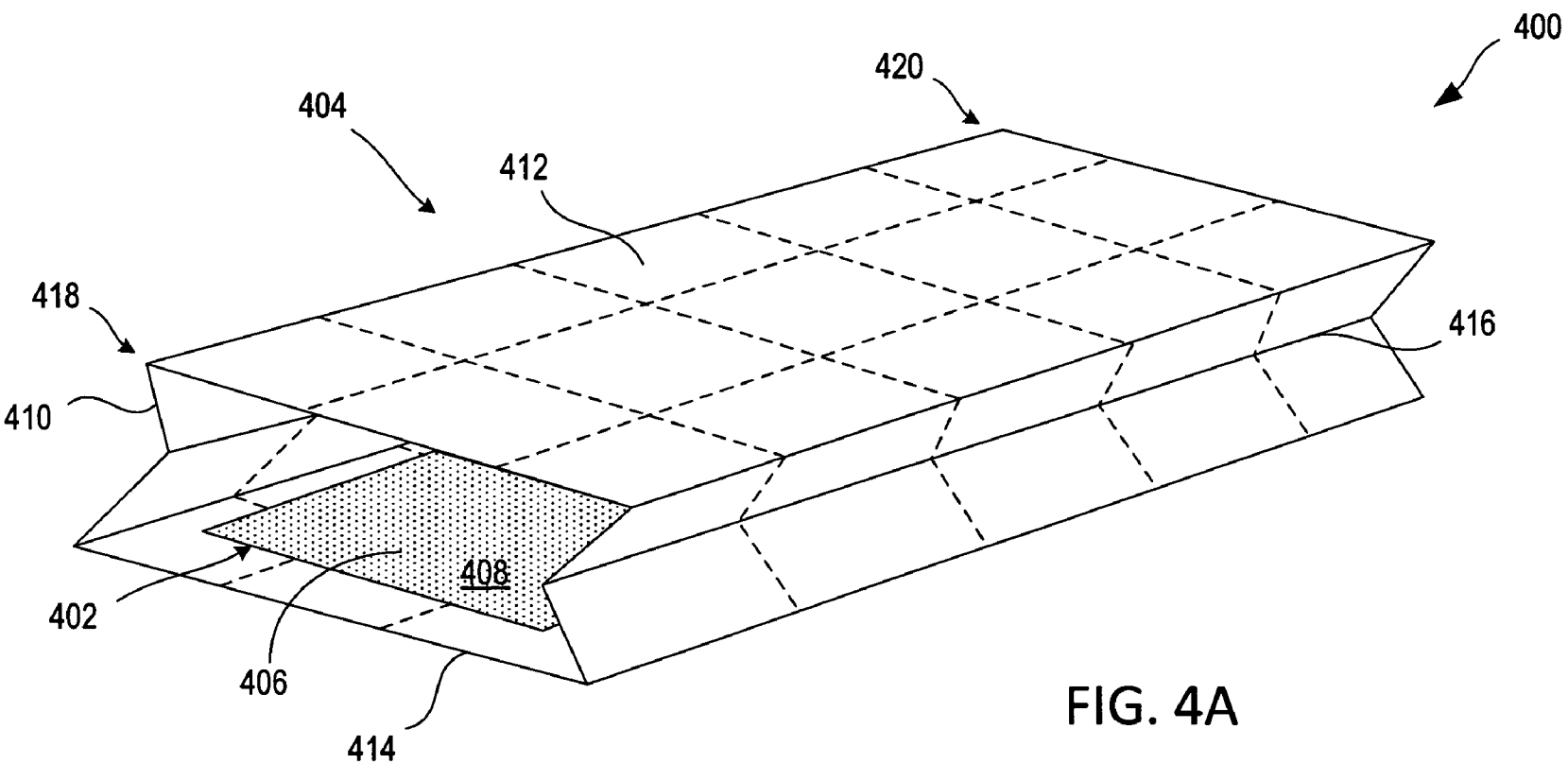
FIG. 4A schematically depicts another exemplary package according to various aspects of the present invention, including a microwave energy interactive card and a microwave energy interactive sleeve or wrapper.
Figure 4B:
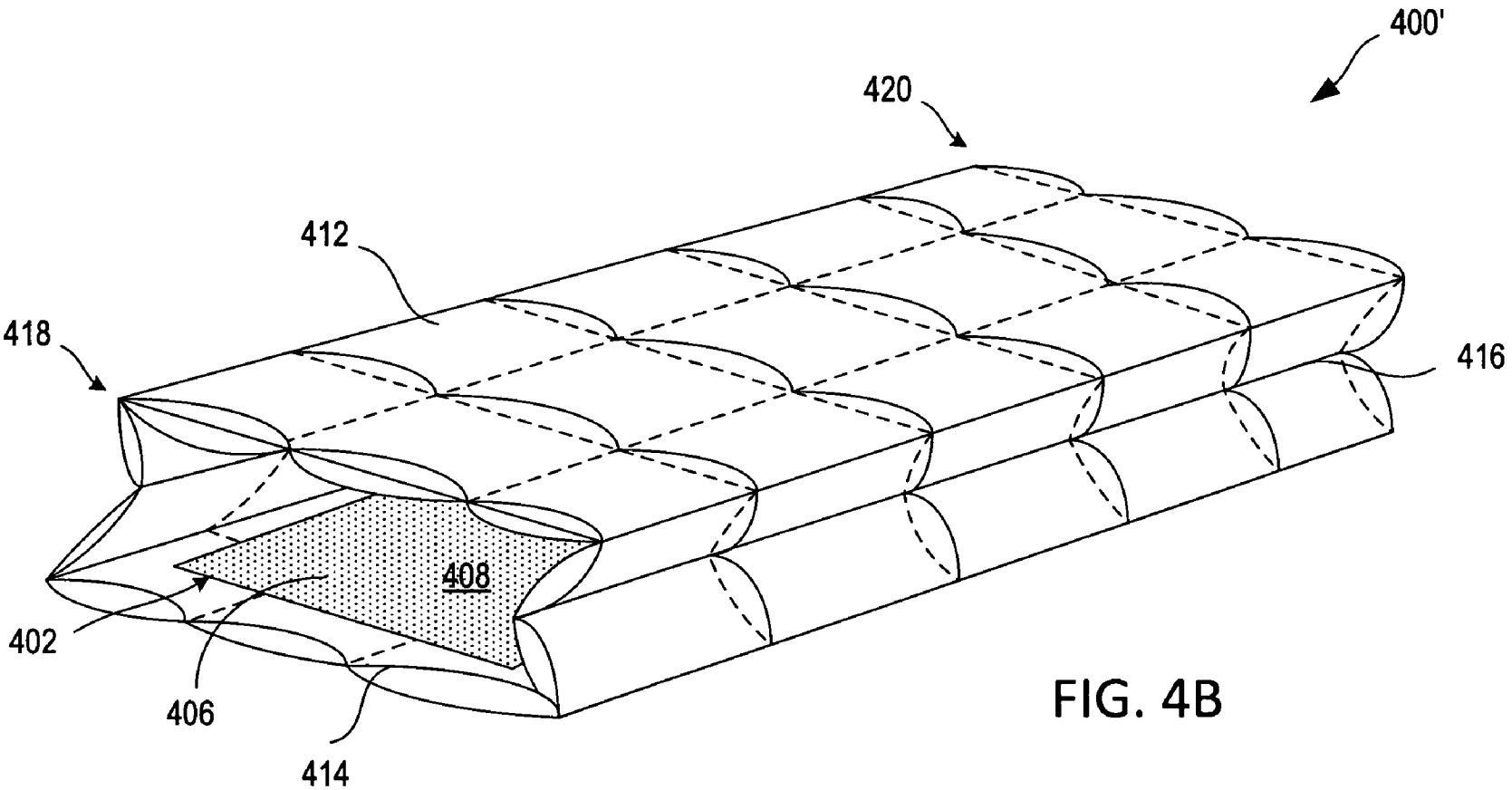
FIG. 4B schematically depicts the package of FIG. 4A, after exposure to microwave energy.

Still viewing FIG. 1A, the package includes a pouch 104 dimensioned to receive the card 102 with a food item (not shown) thereon. In this example, the pouch 104 is generally rectangular in shape. However, the pouch 104 may have any regular or irregular shape, as needed or desired for a particular application. The pouch 104 generally includes a first panel or side 114 and a second panel or side 116 joined as needed to form a cavity or interior space 118 therebetween. In this example, the pouch 104 includes an open end 120 and a closed or sealed end 122. However, in other exemplary embodiments, the pouch may be have two closed ends and may be provided with the food item and card therein. In other exemplary embodiments, the second component may comprise a wrapper, for example, a flat sheet that is folded around the card or a tubular sheath with two open ends into which the card may be placed (e.g., as shown in FIGS. 4A and 4B).

The various pouches used in accordance with the invention may be formed in any suitable manner. It is contemplated that the pouch may be designed from a single sheet folded over and sealed, or may be formed from two or more panels joined as needed. Thus, although the pouch may be described as having panels that are joined along respective edges, it will be understood that the pouch may be formed from a single sheet of material or multiple sheets, as desired.

If desired, the pouch 104 may include one or more microwave energy interactive elements that alter (e.g., enhances, diminishes, or directs) the effect of microwave energy on a food item heated within the pouch 104. In this example, a susceptor film 124 overlies at least a portion of the interior of the pouch 104, and in particular, overlies at least a portion of panels 114 and 116, and defines at least a portion of a food-contacting surface 126. The susceptor film 124 includes a layer of microwave energy interactive material 128 (schematically shown by stippling in FIG. 1A) supported on a polymer film 130 or other substrate 130, examples of which are described above. The susceptor film 124 may be joined at least partially to a flexible support layer or support 132 using an adhesive (not shown) or other suitable material. Numerous other examples of microwave energy interactive elements are provided above.

Figure 1C:
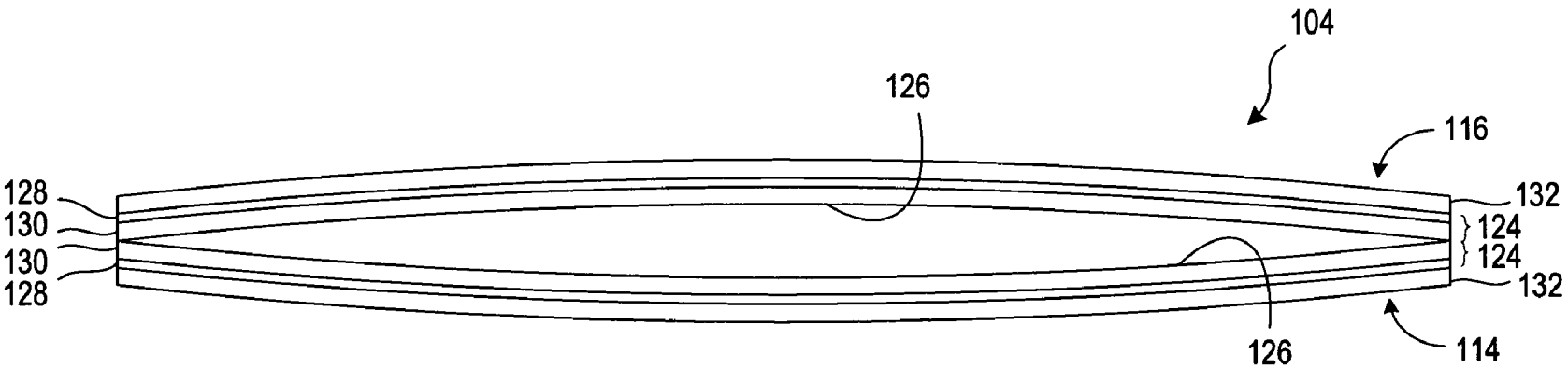
FIG. 1C is a schematic cross-sectional view of the microwave energy interactive pouch of FIG. 1A, taken along a line 1C-1C.

In this and other aspects and examples of the invention, depending on the desired degree of flexibility, the support, for example, support 132 in FIG. 1C, may comprise a paper or paper-based material generally having a basis weight of from about 15 to about 60 lbs/ream, for example, from about 20 to about 40 lbs/ream. In one particular example, the paper has a basis weight of about 25 lbs/ream. Alternatively, the support may comprise a polymer or polymeric material, such as those described above. Examples of polymers that may be suitable for use with the present invention include, but are not limited to, polycarbonate; polyolefins, e.g. polyethylene, polypropylene, polybutylene, and copolymers thereof; polytetrafluoroethylene; polyesters, e.g. polyethylene terephthalate, e.g., coextruded polyethylene terephthalate; vinyl polymers, e.g., polyvinyl chloride, polyvinyl alcohol, ethylene vinyl alcohol, polyvinylidene chloride, polyvinyl acetate, polyvinyl chloride acetate, polyvinyl butyral; acrylic resins, e.g. polyacrylate, polymethylacrylate, and polymethylmethacrylate; polyamides, e.g., nylon 6,6; polystyrenes; polyurethanes; cellulosic resins, e.g., cellulosic nitrate, cellulosic acetate, cellulosic acetate butyrate, ethyl cellulose; copolymers of any of the above materials; or any blend or combination thereof.

To use the package 100 in accordance with one exemplary method, a food item is placed on the card 102 within the package 100. Depending on the particular food item, instructions may be provided to the user to close the open end 120 of the pouch 104 or to leave the pouch 104 in an open configuration. Alternatively, the food item may be provided sealed in the pouch 104, and the user may be instructed to leave the pouch 104 closed or open one end to allow for venting of moisture. The various possibilities will be understood by those of skill in the art.

Upon exposure to microwave energy, the microwave energy interactive material that forms susceptors 106 and 128 converts the microwave energy to thermal energy, which then may transfer to the adjacent food item (not shown). As a result, the browning and/or crisping of the surface of the food item may be enhanced. It will be noted that when the card 102 is seated within the pouch 104 on panel 114, microwave interactive elements 106 and 128 are in a superposed, synergistic relationship. It has been found that by superposing the elements in this manner, the portions of a food item seated on the card 102 adjacent the superposed elements are subject to greater temperatures and, therefore, enhanced browning and/or crisping, as compared with either element alone. It will be understood that this enhanced effect can be seen with a variety of different microwave energy interactive elements and materials in numerous configurations, and that such configurations are contemplated hereby.

Although a susceptor 106 is illustrated in FIGS. 1A and 1B, other microwave energy interactive elements may be used with the various packages of the invention. By way of example, and not limitation, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item.

It also may be beneficial to create one or more discontinuities or inactive regions to prevent overheating or charring of the construct. By way of example, and not limitation, in the pouch 104 illustrated in FIG. 1A, the concentration of heat generated along the edges of adjacent panels, for example, panels 114 and 116, may be sufficient to cause the underlying support, for example, paper, to become scorched. As such, the peripheral portions of one or more of panels 114 and/or 116 may be designed to be microwave inactive, for example, by forming these areas without a microwave energy interactive material or by deactivating the microwave energy interactive material in these areas.

Further still, one or more panels, portions of panels, or portions of the construct may be designed to be microwave energy inactive to ensure that the microwave energy is focused efficiently on the areas to be browned and/or crisped, rather than being lost to portions of the food item not intended to be browned and/or crisped or to the heating environment. For example, in the exemplary card 102 shown in FIG. 1A, the microwave energy interactive element 106 overlies a central or non-peripheral portion of the support 112 where the food is intended to be seated. In this example, it is expected that the food item will not overlie the peripheral areas or edges of the card 102. However, numerous other configurations are contemplated by the invention.

Figure 2A:
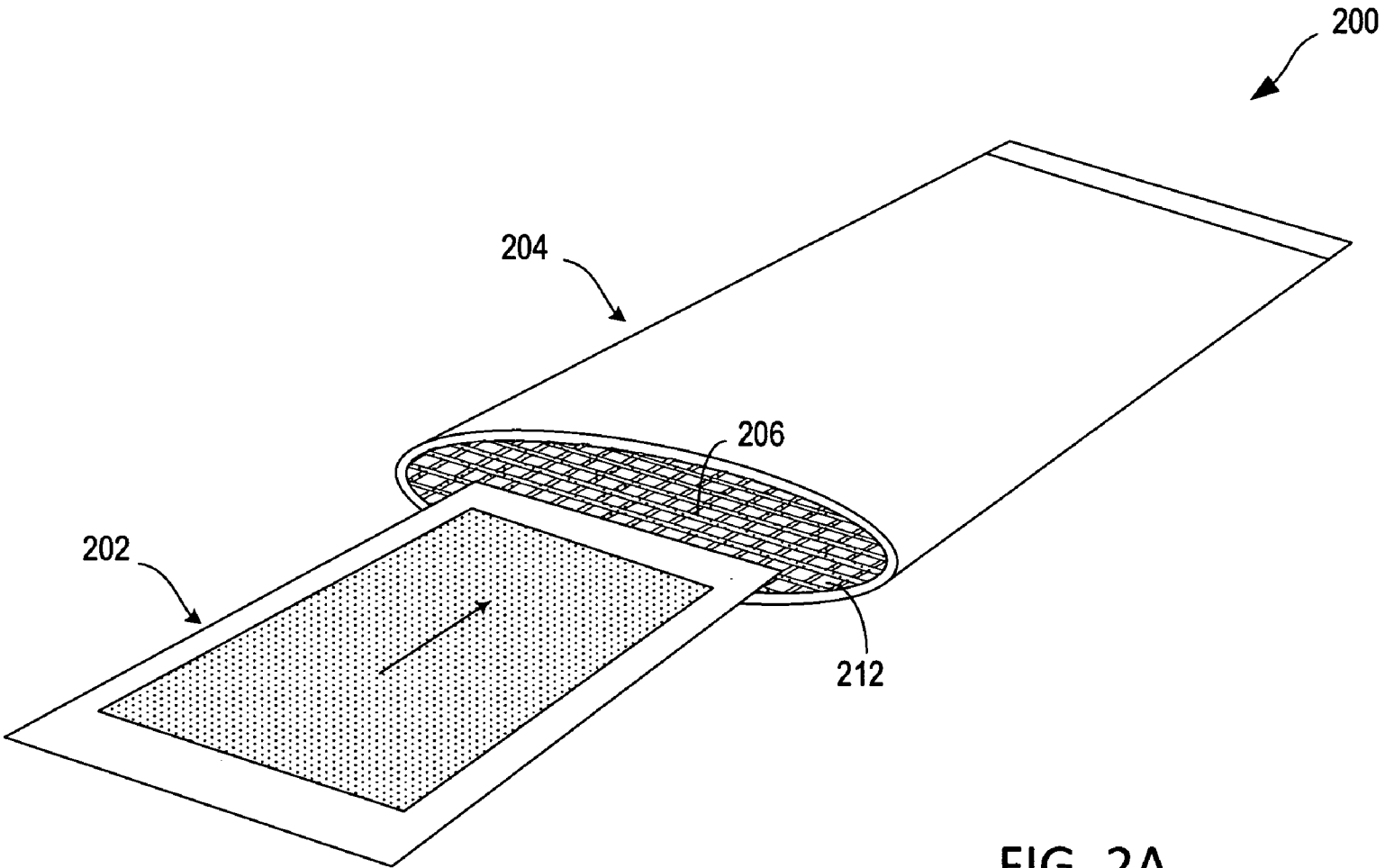
FIG. 2A schematically depicts another exemplary package according to various aspects of the present invention, including a microwave energy interactive card and a microwave energy interactive pouch.

FIG. 2A illustrates another package 200 according to various aspects of the invention. The package is similar to the package 100 of FIGS. 1A-1C, except for differences noted below and differences that will be apparent to those of skill in the art.

As with the package 100 of FIGS. 1A-1C, the package 200 includes a first component comprising a dimensionally stable microwave energy interactive card 202 for receiving a food item (not shown) thereon and a second component comprising a microwave energy interactive pouch 204 for receiving the food item and card 202. The card 202 and pouch 204 may have any shape needed for a particular food item.

Figure 2B:
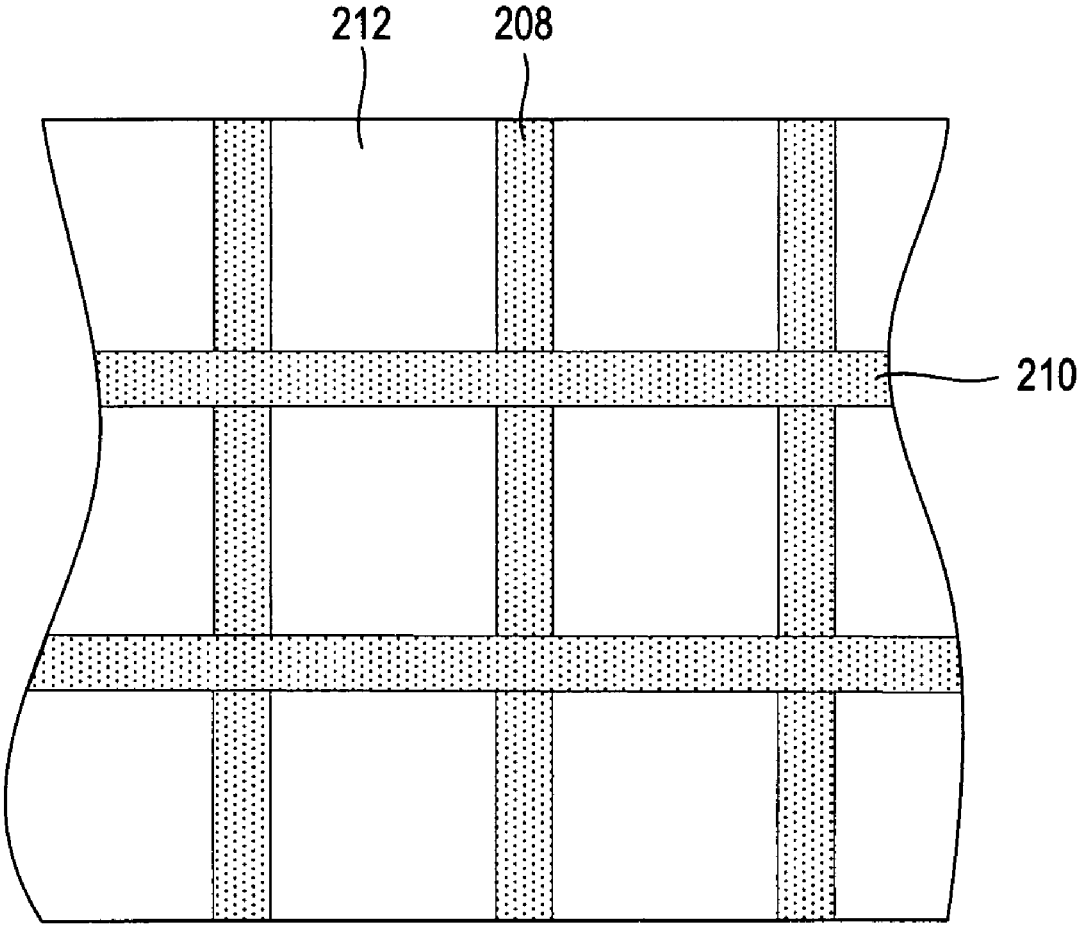
FIG. 2B is an enlarged, schematic top plan view of the pouch of FIG. 2A, with this view illustrating the arrangement of microwave energy interactive material overlying at least a portion of the interior of the pouch of FIG. 2A.

In this example, however, the microwave energy interactive element 206 overlying at least a portion of the interior surface of the pouch 204 comprises a grid-like arrangement or pattern of microwave energy interactive material, with longitudinal segments 208 and transverse segments 210 being substantially perpendicular to one another, as schematically illustrated in FIG. 2B. The spaces 212 between the microwave energy interactive material segments 208 and 210 are substantially transparent to microwave energy.

It will be understood that, in this and other aspects of the invention, the microwave energy interactive element may be supported on a substrate, for example, a polymer film, to form a microwave energy interactive structure or web. For simplicity, such substrate is not necessarily discussed hereafter with respect to the various other examples. Instead, it will be understood that the microwave energy interactive element may include such supporting layers if desired. Thus, the term "microwave energy interactive element" may be used sometimes hereafter to refer to the combination of such a microwave energy interactive element and the substrate on which it is supported.

It will be understood that the relative size of the microwave energy interactive material segments and the spaces between them can be adjusted as needed or desired for a particular application. For example, where more browning and/or crisping is desired, the microwave energy interactive material segments may be wider and the transparent spaces between them may be smaller. In contrast, where more heating is desired, and less browning and/or crisping, the microwave energy interactive material segments may be narrower and the transparent spaces therebetween larger.

Figure 3:
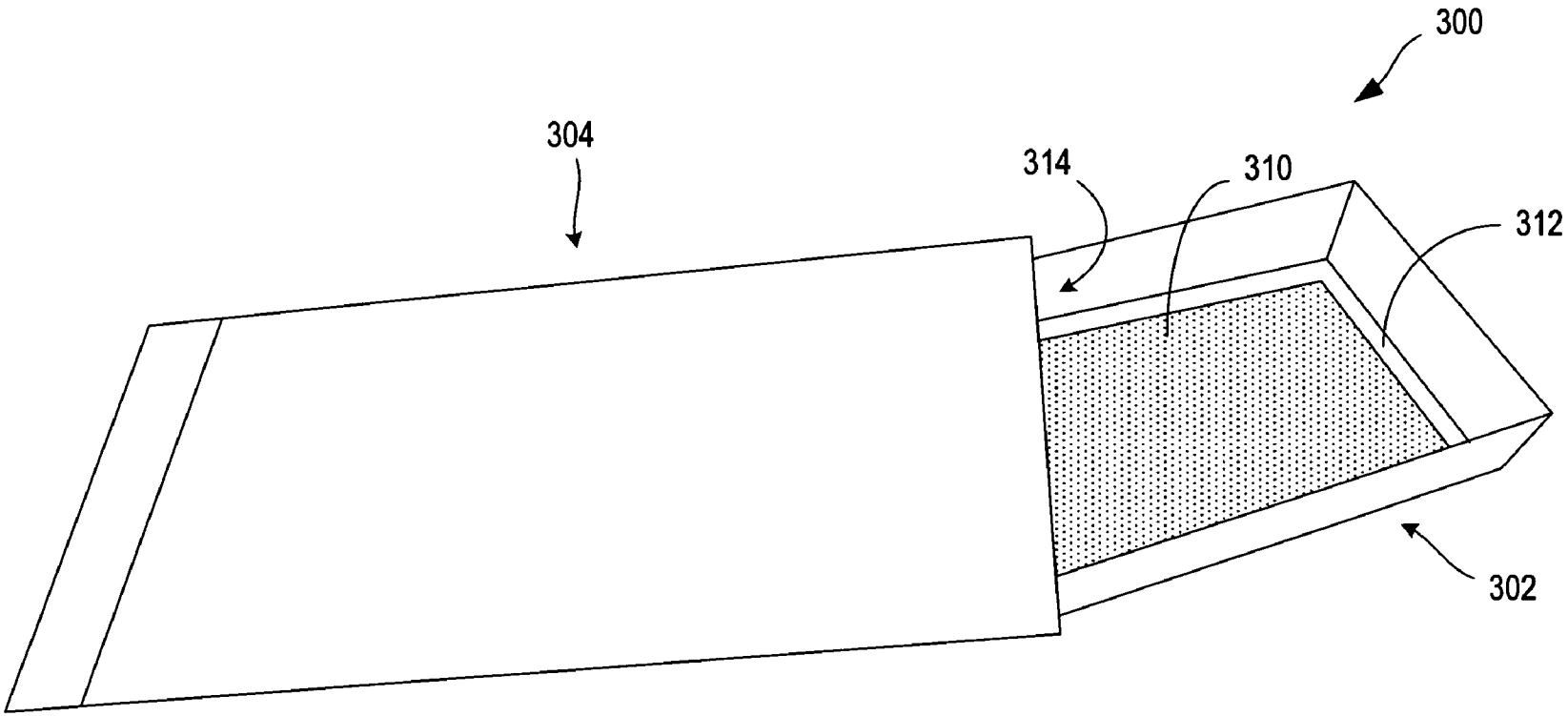
FIG. 3 schematically depicts yet another exemplary package according to various aspects of the present invention, including a microwave energy interactive card and a microwave energy interactive tray.

FIG. 3 illustrates yet another package 300 according to various aspects of the invention. The package 300 includes a first component comprising a tray 302 and a second component comprising a pouch 304 dimensioned to receive the tray 302.

The tray 302 includes a base panel 306 and a plurality of somewhat upstanding walls 308. In this example, the tray 302 is somewhat rectangular in shape. However, it will be understood that the tray may have any geometry, as needed or desired for a particular application. A microwave energy interactive element 310 (schematically shown by stippling), for example, a susceptor optionally supported on a polymer film, overlies and may be joined to at least a portion of the base panel 312 of the tray 302 in an overlapping relationship such that the microwave interactive element 310 faces the interior 314 of the pouch 304.

The pouch 304 may be any suitable pouch and may include a microwave energy interactive element (not shown), similar to that shown, for example, in FIG. 1A or 2A. However, other pouches, wrappers, and other constructs for receiving the card and food item are contemplated hereby.

In this and other aspects, embodiments, and examples of the invention, the tray may be joined fixedly at least partially to the pouch, may be joined removably to the pouch, or may be separate from the pouch. Where the tray is joined removably to or is separate from the pouch, the tray may be used as a container for transporting and holding the food item (not item) prior to and during consumption. Thus, for example, the tray may be joined removably to the pouch using one or more low tack adhesive dots or strips, such that after heating, the tray may be removed from the pouch and used to contain the heated food item, for example, French fries, egg rolls, pizza rolls, bagel snacks, and so forth. In this manner, the present invention provides various packages for convenient storage, heating, browning, and/or crisping, and transportation of a food item before, during, and after heating.

It will be understood that in some circumstances, particularly where the food item has an irregular surface that is difficult to brown and/or crisp, it may be beneficial to form the pouch or wrapper at least partially from a microwave energy interactive insulating material. As used herein, the term "microwave energy interactive insulating material" or "microwave energy interactive insulating structure" or "insulating material" or "insulating structure" refers any combination of layers of materials, for example, paper layers, polymer film layers, and microwave energy interactive elements, that is both responsive to microwave energy and capable of providing some degree of thermal insulation when used to heat a food item.

The insulating material may include various components, provided that each is resistant to softening, scorching, combusting, or degrading at typical microwave oven heating temperatures, for example, at from about 250° F. to about 425° F. The insulating material may include both microwave energy responsive or interactive elements or components, and microwave energy transparent or inactive elements or components.

In one aspect, the insulating material comprises one or more susceptor layers in combination with one or more expandable insulating cells. Such materials sometimes may be referred to herein as "expandable cell insulating materials". Additionally, the insulating material may include one or more microwave energy transparent or inactive materials to provide dimensional stability, to improve ease of handling the microwave energy interactive material, and/or to prevent contact between the microwave energy interactive material and the food item.

For example, an insulating material may comprise a microwave energy interactive material supported on a first polymer film layer, a moisture-containing layer superposed with the microwave energy interactive material, and a second polymer film layer joined to the moisture-containing layer in a predetermined pattern, thereby forming one or more closed cells between the moisture-containing layer and the second polymer film layer. The closed cells expand or inflate in response to being exposed to microwave energy and cause the microwave energy interactive element to bulge and deform toward the food item. While not wishing to be bound by theory, it is believed that the heat generated by the microwave energy interactive material causes moisture in the moisture-containing layer to evaporate, thereby exerting pressure on the adjacent layers. As a result, the expandable cells bulge outwardly away from the expanding gas, thereby allowing the expandable cell insulating material to conform more closely to the contours of the surface of the food item. As a result, the heating, browning, and/or crisping of the food item can be enhanced, even if the surface of the food item is somewhat irregular.

Further, the water vapor, air, and other gases contained in the closed cells provide insulation between the food item and the ambient environment of the microwave oven, thereby increasing the amount of sensible heat that stays within or is transferred to the food item. Such insulating materials also may help to retain moisture in the food item when cooking in the microwave oven, thereby improving the texture and flavor of the food item. Additional benefits and aspects of such materials are described in PCT Publication No. WO 2003/66435, U.S. Pat. No. 7,019,217, and U.S. Patent Application Publication No. 20060113300 A1, each of which is incorporated by reference herein in its entirety.

A microwave energy interactive insulating material, for example, an expandable cell insulating material, may be used to form the various packages of the invention in numerous ways. By way of example, and not limitation, FIGS. 4A and 4B depict an exemplary package 400 using an insulating material according to various aspects of the present invention. The package 400 includes a rigid or semi-rigid card 402 for supporting a food item (not shown), and a wrapper or sheath 404 dimensioned to receive the card 402. In this example, the card 402 is somewhat rectangular in shape. However, numerous other regular and irregular shapes are contemplated hereby. Additionally, it will be understood that any of the various cards and trays described herein, and numerous others, may be used in accordance with this aspect. A microwave energy interactive element 406 (schematically shown by stippling), for example, a susceptor optionally supported on a polymer film, defines at least a portion of a food-contacting surface 408 of the card 402.

The wrapper 404 generally is formed from a flexible material capable of conforming to the shape of a food item (not shown) seated on the card 402. In this particular example, the wrapper 404 is formed from a microwave interactive insulating material 410 including a plurality of expandable cells 412 (defined by dashed lines in FIG. 4A), for example, any of the various structures that will be discussed in connection with FIGS. 5A-8, or numerous others.

To use the package 400, a food item (not shown) is placed on the card microwave energy interactive card 402 and placed within the wrapper 404. In some instances, the wrapper may be a sheet that is wrapped around the food item on the card. In other instances, the wrapper may be a pre-formed sheath into which the food item and card can be inserted.

As stated above, each of the various insulating materials or structures includes a microwave energy interactive element, for example, a susceptor. When exposed to microwave energy, at least some of the plurality of insulating cells 412 inflate, as schematically illustrated in FIG. 4B, thereby urging the susceptor within the insulating material 410 (or microwave energy interactive material, as shown in detail, for example in FIGS. 5A-8) towards the food item (not shown) to enhance the heating, browning, and/or crisping thereof. Additionally, the expanded insulating cells 412 serve as insulation to reduce heat loss to the ambient heating environment.

It will be noted that, in this example, the microwave interactive element 406 is in a superposed relationship with the microwave interactive insulating material 410 that forms the bottom 414 of the wrapper 404. By arranging the microwave interactive elements in this manner, the browning and/or crisping of a food item (not shown) seated on the card 402 is enhanced as compared with either element alone.

In this and other aspects of the invention, the wrapper 404 may include pleats, gussets 416, or other features to accommodate the dimensions of the food item, as shown in FIGS. 4A and 4B. Additionally, in this and other aspects of the invention, the wrapper 404 may include one or more features for closing the ends 418 and 420 of the wrapper 404, for example, an adhesive strip, thermal bond, ultrasonic bond, mechanical fastener, or other suitable feature (not shown).

It is contemplated that numerous different microwave energy interactive insulating materials may be used to form a microwave heating package, for example, a pouch or wrapper, in accordance with the invention. Several exemplary insulating materials are depicted in FIGS. 5A-8B. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers.

Figure 5A:
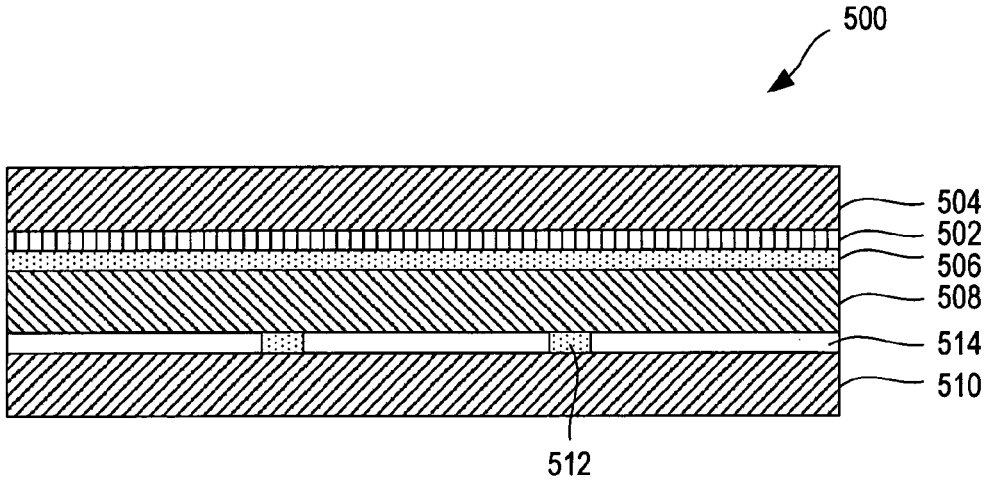
FIG. 5A is a schematic cross-sectional view of an exemplary microwave energy interactive insulating material that may be used to form a package in accordance with various aspects of the present invention.
Figure 5B:
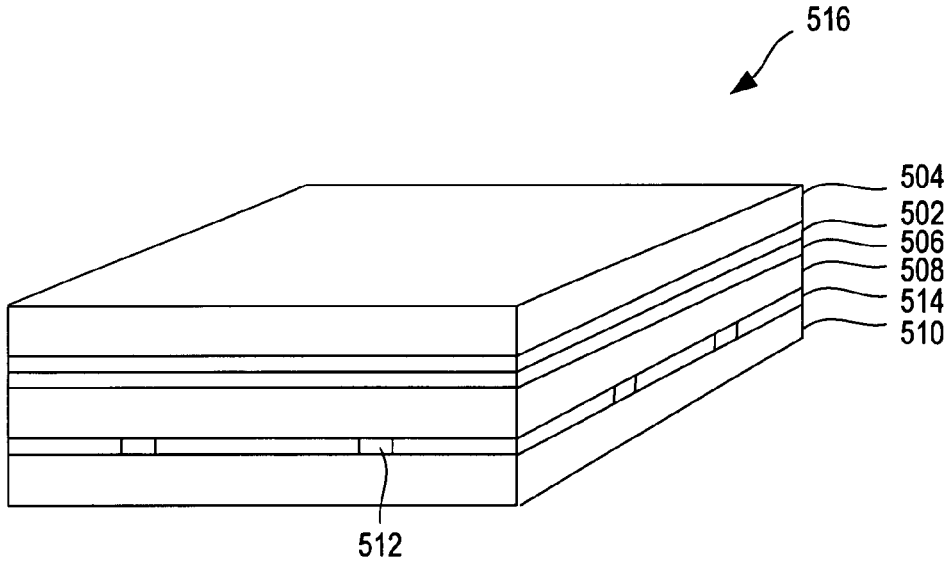
FIG. 5B schematically illustrates the exemplary microwave energy interactive insulating material of FIG. 1A, in the form of a cut sheet.

FIG. 5A depicts an exemplary insulating material 500 that may be used with various aspects of the invention to form a microwave energy interactive pouch or a microwave energy interactive wrapper. In this example, a thin layer of microwave energy interactive material 502 is supported on a first polymer film 504 and bonded by lamination with an adhesive 506 (or otherwise) to a dimensionally stable substrate 508, for example, paper. The substrate 508 is bonded to a second polymer film 510 using a patterned adhesive 512 or other material, such that closed cells 514 are formed in the material 500. The insulating material 500 may be cut and provided as a substantially flat, multi-layered sheet 516, as shown in FIG. 5B.

Figure 5C:
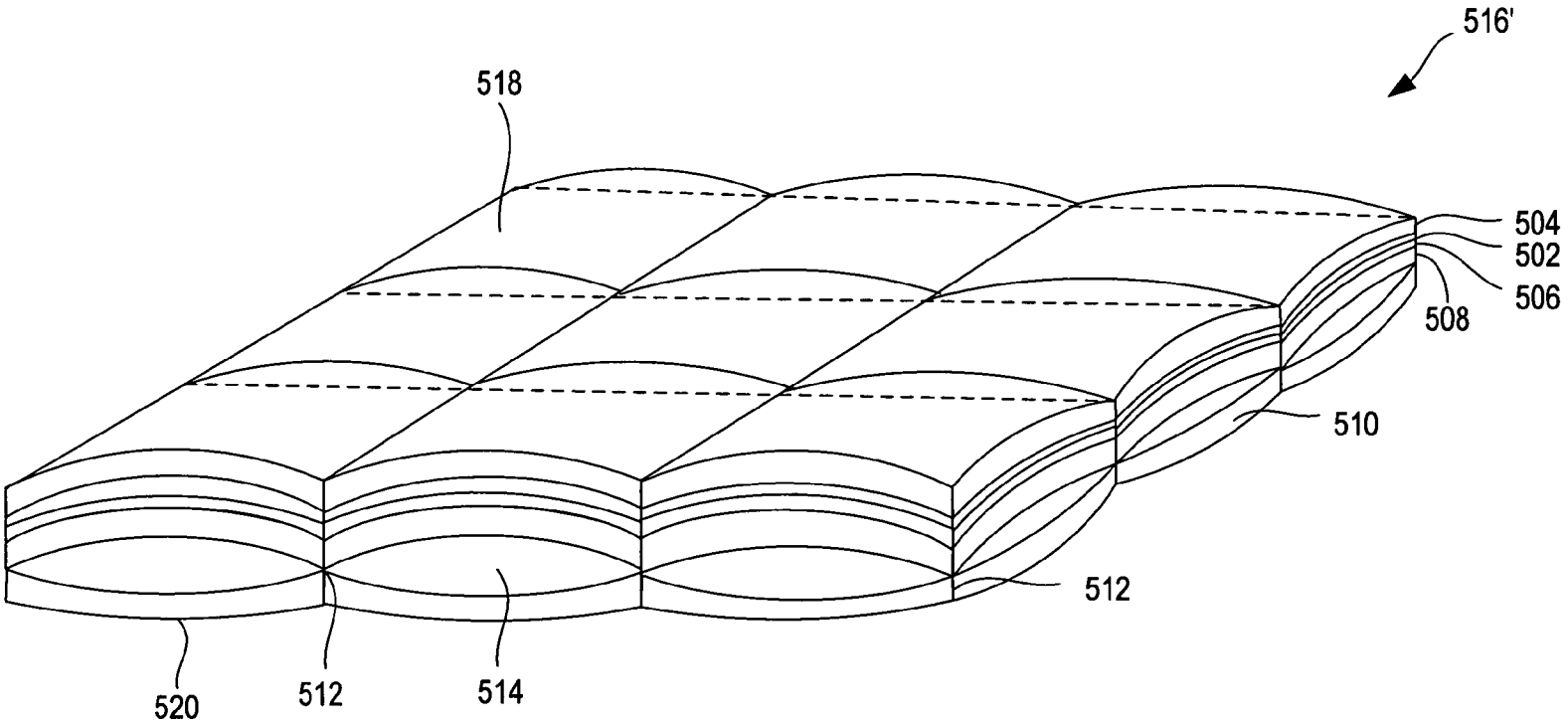
FIG. 5C schematically depicts the exemplary microwave energy interactive insulating sheet of FIG. 5B, upon exposure to microwave energy.

As the microwave energy interactive material 502 heats upon impingement by microwave energy, water vapor and other gases typically held in the substrate 508, for example, paper, and any air trapped in the thin space between the second polymer film 510 and the substrate 508 in the closed cells 514, expand, as shown in FIG. 5C. The resulting insulating material 516' has a quilted or pillowed top surface 518 and bottom surface 520. When microwave heating has ceased, the cells 514 typically deflate and return to a somewhat flattened state.

Figure 5D:
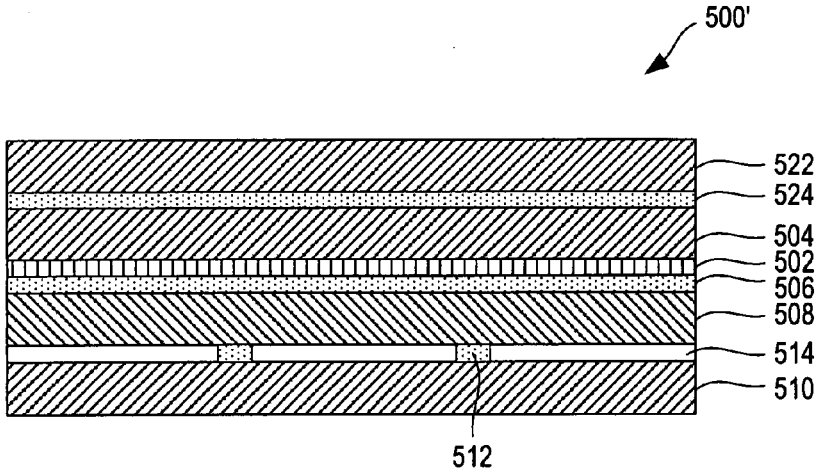
FIG. 5D schematically illustrates a variation of the microwave energy interactive insulating material of FIG. 1A.

If desired, the insulating material 500' may include an additional paper or polymer film layer 522 joined to the first polymer film layer 504 using an adhesive 524 or other suitable material, as shown in FIG. 5D.

Figure 6:
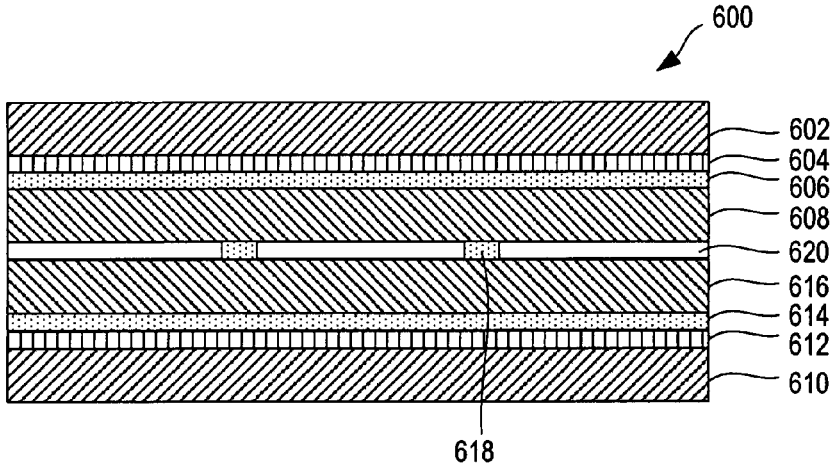
FIG. 6 is a schematic cross-sectional view of another exemplary microwave energy interactive insulating material that may be used to form a package in accordance with various aspects of the present invention.
Figure 7:
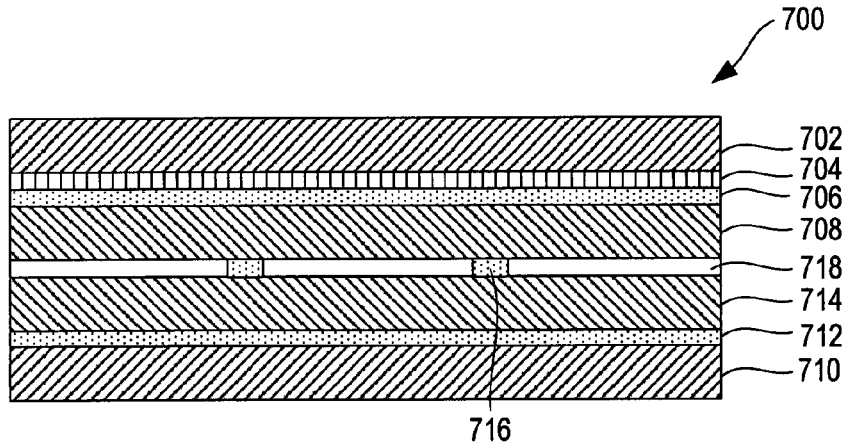
FIG. 7 is a schematic cross-sectional view of yet another exemplary microwave energy interactive insulating material that may be used to form a package in accordance with various aspects of the present invention.

FIGS. 6 and 7 depict other exemplary insulating materials according to various aspects of the present invention. Referring first to FIG. 6, an insulating material 600 is shown with two symmetrical layer arrangements adhered together by a patterned adhesive layer. The first symmetrical layer arrangement, beginning at the top of the drawings, comprises a polymer film layer 602, a microwave energy interactive metal layer 604, an adhesive layer 606, and a paper or paperboard layer 608. The metal layer 604 may comprise a metal, such as aluminum, deposited along at least a portion of the polymer film layer 602. The polymer film 602 and metal layer 604 collectively comprise a susceptor. The adhesive layer 606 bonds the polymer film 602 and the metal layer 604 to the paperboard layer 608.

The second symmetrical layer arrangement, beginning at the bottom of the drawings, also comprises a polymer film layer 610, a metal layer 612, an adhesive layer 614, and a paper or paperboard layer 616. If desired, the two symmetrical arrangements may be formed by folding one layer arrangement onto itself. The layers of the second symmetrical layer arrangement are bonded together in a similar manner as the layers of the first symmetrical arrangement. A patterned adhesive layer 618 is provided between the two paper layers 608 and 616, and defines a pattern of closed cells 620 configured to expand when exposed to microwave energy. By using an insulating material 600 having two metal layers 604 and 612, more heat is generated, thereby achieving greater cell loft. As a result, such a material is able to elevate a food item seated thereon to a greater extent than an insulating material having a single microwave energy interactive material layer.

Referring to FIG. 7, yet another insulating material 700 is shown. The material 700 includes a polymer film layer 702, a metal layer 704, an adhesive layer 706, and a paper layer 708. Additionally, the material 700 may include a second polymer film layer 710, an adhesive 712, and a paper layer 714. The layers may be adhered or affixed by a patterned adhesive 716 that defines a plurality of closed expandable cells 718.

Figure 8A:
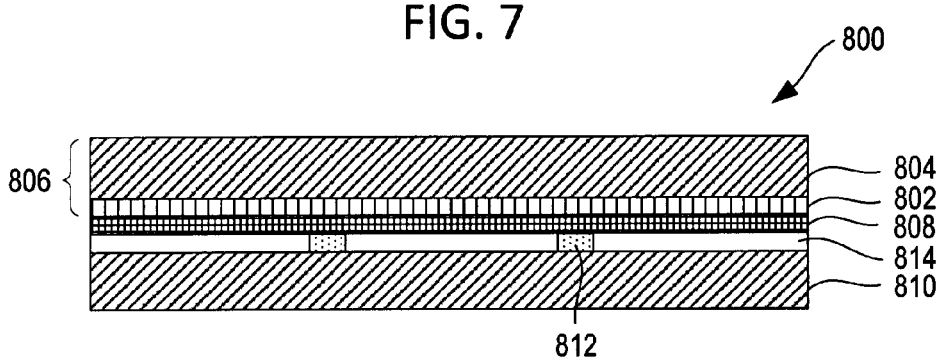
FIG. 8A is a schematic cross-sectional view of still another exemplary microwave energy interactive insulating material that may be used to form a package in accordance with various aspects of the present invention.

Turning now to FIG. 8A, another exemplary insulating material 800 is depicted. In this example, one or more reagents are used to generate a gas that expands the cells of the insulating material. For example, the reagents may comprise sodium bicarbonate ($NaHCO_3$) and a suitable acid. When exposed to heat, the reagents react to produce carbon dioxide. As another example, the reagent may comprise a blowing agent. Examples of blowing agents that may be suitable include, but are not limited to, p-p'-oxybis(benzenesulphonylhydrazide), azodicarbonamide, and p-toluenesulfonylsemicarbazide. However, it will be understood that numerous other reagents and released gases are contemplated hereby.

In the example shown in FIG. 8A, a thin layer of microwave interactive material 802 is supported on a first polymer film 804 to form a susceptor film 806. One or more reagents 808, optionally within a coating, lie adjacent at least a portion of the layer of microwave interactive material 802.

Figure 8B:
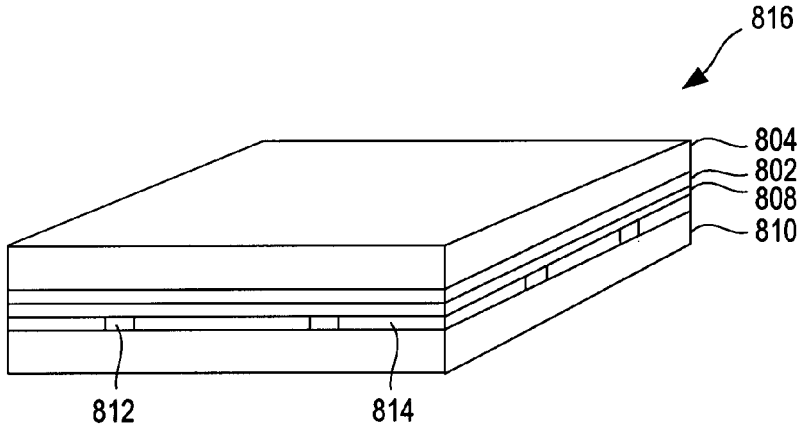
FIG. 8B schematically depicts the exemplary microwave energy interactive insulating material of FIG. 8A, in the form of a cut sheet.
Figure 8C:
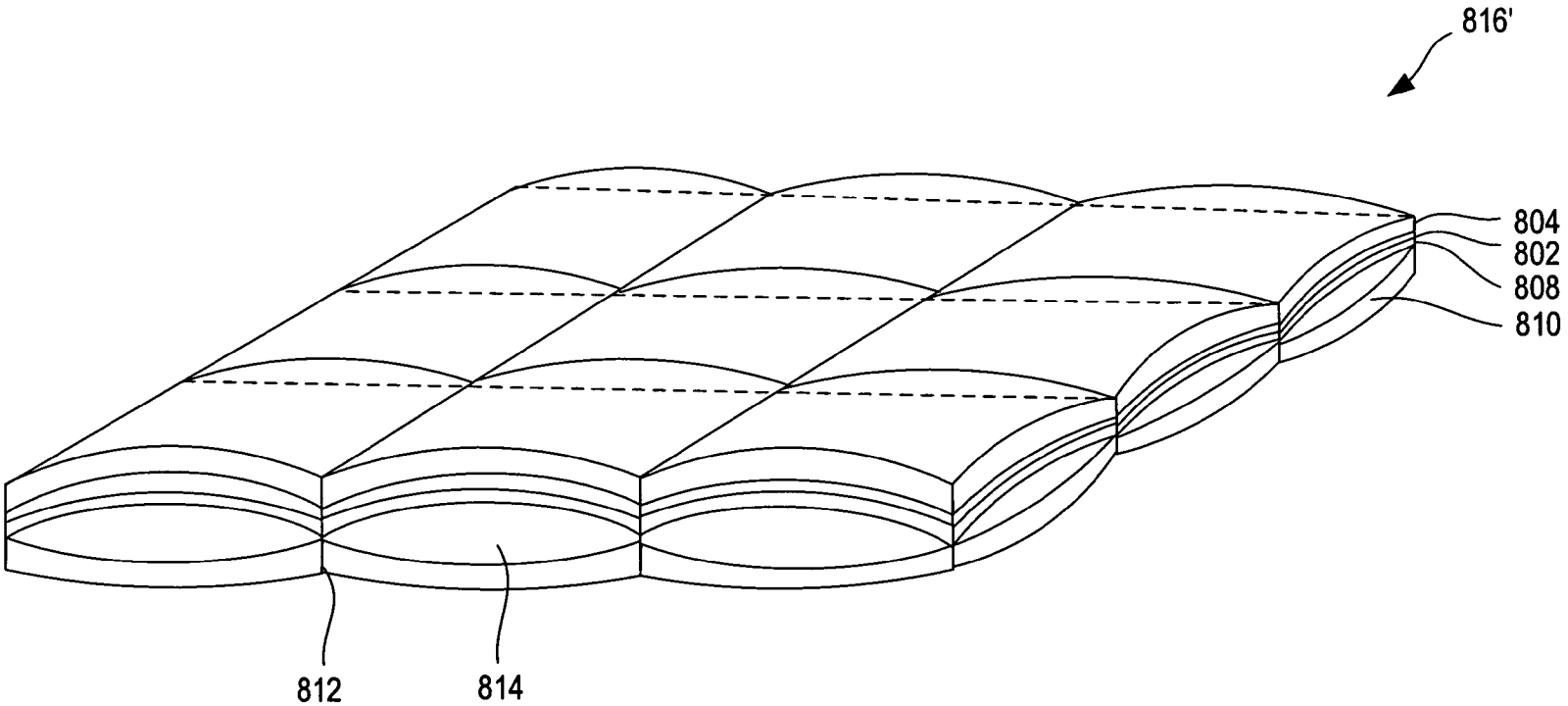
FIG. 8C schematically depicts the exemplary microwave energy interactive insulating sheet of FIG. 8B, upon exposure to microwave energy.

The reagent 808 coated susceptor film 806 is joined to a second polymer film 810 using a patterned adhesive 812 or other material, or using thermal bonding, ultrasonic bonding, or any other suitable technique, such that closed cells 814 (shown as a void) are formed in the material 800. The microwave energy insulating material 800 can be cut into a sheet 816, as shown in FIG. 8B.

As discussed in connection with the other exemplary insulating materials, as the microwave interactive material 802 heats upon impingement by microwave energy, water vapor or other gases are released from or generated by the reagent 808. The resulting gas applies pressure on the susceptor film 806 on one side and the second polymer film 810 on the other side of the closed cells 814. Each side of the material 800 reacts simultaneously, but uniquely, to the heating and vapor expansion to form a pillowed or quilted insulating material 816'. This expansion may occur within 1 to 15 seconds in an energized microwave oven, and in some instances, may occur within 2 to 10 seconds. Even without a paper or paperboard layer, the water vapor resulting from the reagent is sufficient both to inflate the expandable cells and to absorb any excess heat from the microwave energy interactive material. Such materials are described further in U.S. Patent Application Publication No. 2006/0289521 A1, which is incorporated by reference herein in its entirety.

Typically, when microwave heating has ceased, the cells or quilts may deflate and return to a somewhat flattened state. However, if desired, the insulating material may comprise a durably expandable microwave energy interactive insulating material. As used herein, the term "durably expandable microwave energy interactive insulating material" or "durably expandable insulating material" refers to an insulating material that includes expandable cells that tend to remain at least partially, substantially, or completely inflated after exposure to microwave energy has been terminated. Such materials may be used to form multi-functional packages and other constructs that can be used to heat a food item, to provide a surface for safe and comfortable handling of the food item, and to contain the food item after heating. Thus, a durably expandable insulating material may be used to form a package or construct that facilitates storage, preparation, transportation, and consumption of a food item, even "on the go".

In one aspect, a substantial portion or number of the plurality of cells remain substantially expanded for at least about 1 minute after exposure to microwave energy has ceased. In another aspect, a substantial portion or number of the plurality of cells remain substantially expanded for at least about 5 minutes after exposure to microwave energy has ceased. In still another aspect, a substantial portion or number of the plurality of cells remain substantially expanded for at least about 10 minutes after exposure to microwave energy has ceased. In yet another aspect, a substantial portion or number of the plurality of cells remain substantially expanded for at least about 30 minutes after exposure to microwave energy has ceased. It will be understood that not all of the expandable cells in a particular construct or package must remain inflated for the insulating material to be considered to be "durable". Instead, only a sufficient number of cells must remain inflated to achieve the desired objective of the package or construct in which the material is used.

For example, where a durably expandable insulating material is used to form all or a portion of a package or construct for storing a food item, heating, browning, and/or crisping the food item in a microwave oven, removing it from the microwave oven, and removing it from the construct, only a sufficient number of cells need to remain at least partially inflated for the time required to heat, brown, and/or crisp the food item and remove it from the microwave oven after heating. In contrast, where a durably expandable insulating material is used to form all or a portion of a package or construct for storing a food item, heating, browning, and/or crisping the food item in a microwave oven, removing the food item from the microwave oven, and consuming the food item within the construct, a sufficient number of cells need to remain at least partially inflated for the time required to heat, brown, and/or crisp the food item, remove it from the microwave oven after heating, and transport the food item until the food item and/or construct has cooled to a surface temperature comfortable for contact with the hands of the user.

Any of the durably expandable insulating materials of the present invention may be formed at least partially from one or more barrier materials, for example, polymer films, that substantially reduce or prevent the transmission of oxygen, water vapor, or other gases from the expanded cells. Examples of such materials are described above. However, the use of other materials is contemplated hereby.

Any of the insulating materials described herein or contemplated hereby may include an adhesive pattern or thermal bond pattern that is selected to enhance cooking of a particular food item. For example, where the food item is a larger item, the adhesive pattern may be selected to form substantially uniformly shaped expandable cells. Where the food item is a small item, the adhesive pattern may be selected to form a plurality of different sized cells to allow the individual items to be variably contacted on their various surfaces. While several examples are provided herein, it will be understood that numerous other patterns are contemplated hereby, and the pattern selected will depend on the heating, browning, crisping, and insulating needs of the particular food item.

If desired, multiple layers of insulating materials may be used to enhance the insulating properties of the insulating material and, therefore, enhance the browning and crisping of the food item. Where multiple layers are used, the layers may remain separate or may be joined using any suitable process or technique, for example, thermal bonding, adhesive bonding, ultrasonic bonding or welding, mechanical fastening, or any combination thereof. In one example, two sheets of an insulating material may be arranged so that their respective susceptor film layers are facing away from each other. In another example, two sheets of an insulating material may be arranged so that their respective susceptor film layers are facing towards each other. In still another example, multiple sheets of an insulating material may be arranged in a like manner and superposed. In a still further example, multiple sheets of various insulating materials are superposed in any other configuration as needed or desired for a particular application.

Figure 9A:
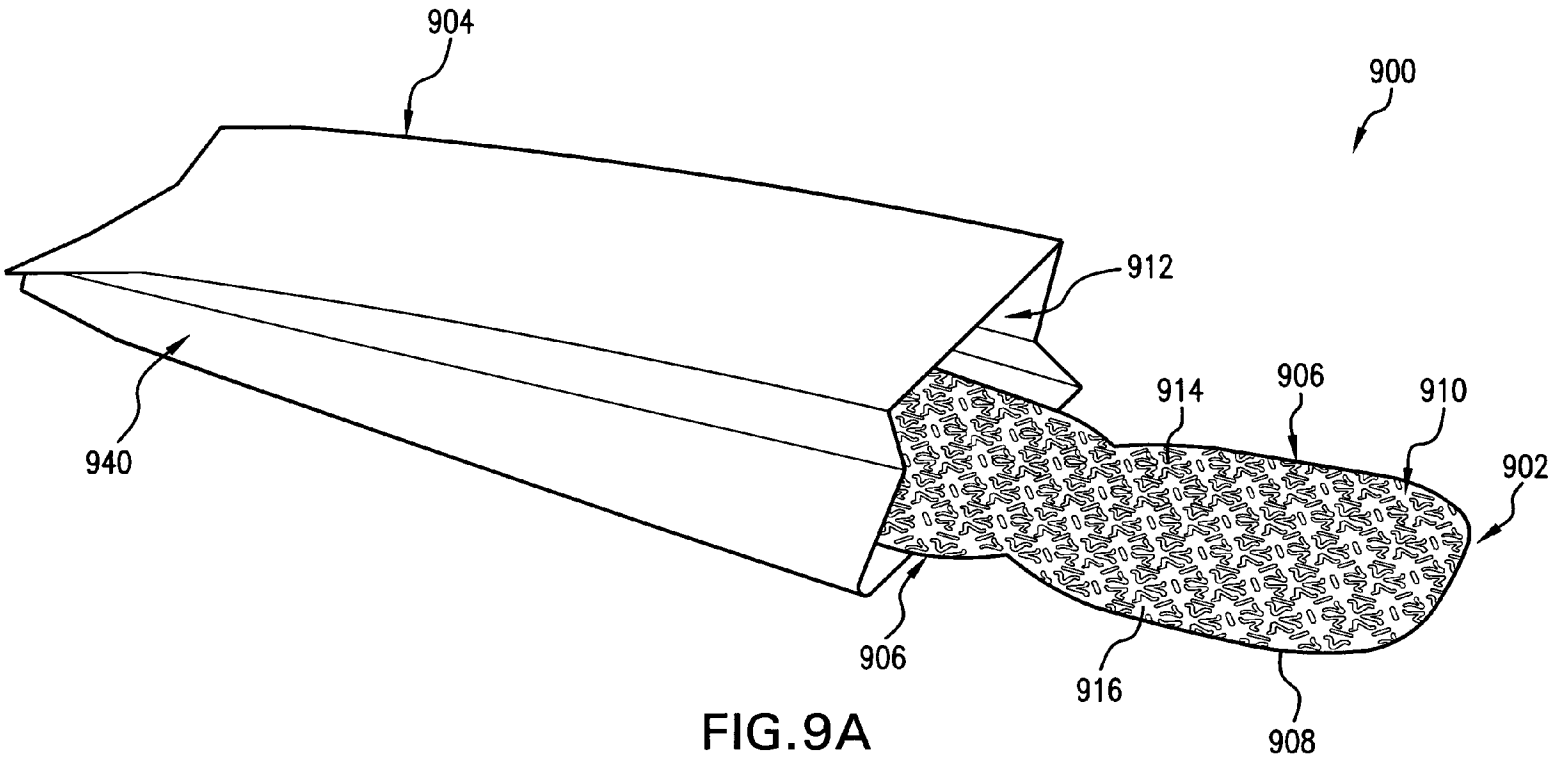
FIG. 9A schematically depicts another exemplary package according to various aspects of the present invention, including a microwave energy interactive card and microwave energy interactive pouch or wrapper.
Figure 9B:
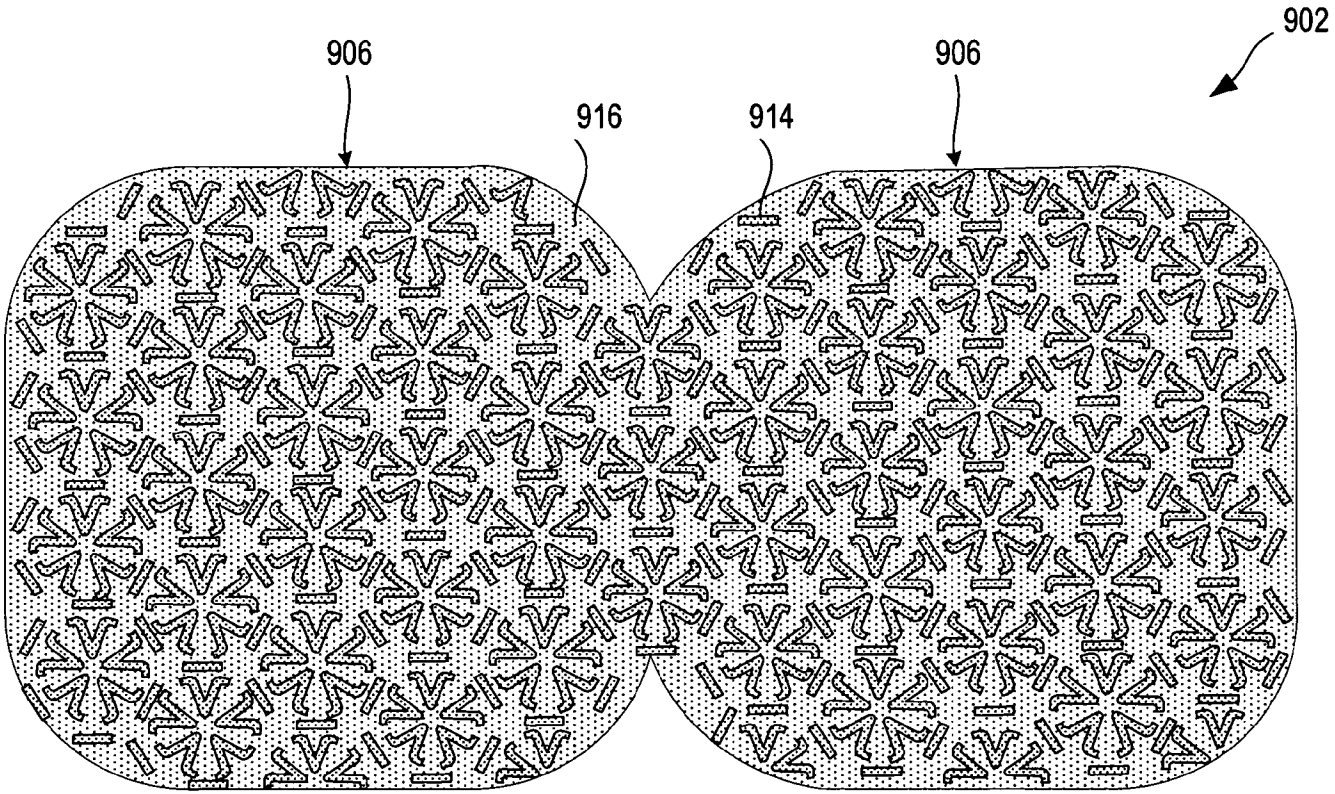
FIG. 9B is an isolated, schematic top plan view of the microwave energy interactive card of FIG. 9A.

FIGS. 9A-9F depict yet another package 900 according to various aspects of the present invention. As shown in FIG. 9A, the package 900 includes a dimensionally stable microwave energy interactive card 902 for supporting a food item (not shown) thereon, and a flexible microwave energy interactive pouch 904 dimensioned to receive the card 902. In this example, the card 902 is somewhat oblong in shape with two somewhat square, rounded lobes or portions 906, as best seen in FIG. 9B, suitable for heating, browning, and/or crisping various food items, for example, biscuits, sandwiches, or chicken patties. As with the various other exemplary packages described herein and/or contemplated hereby, the card 902 may be joined fixedly at least partially to the pouch 904, may be joined removably to the pouch 904, or may be separate from the pouch 904.

Now viewing FIGS. 9A-9D, the card 902 includes a microwave energy interactive web or structure 910 overlying and at least partially joined to at least a portion of a dimensionally stable support 908 in a face-to-face, overlapping relationship, with the microwave energy interactive structure 910 intended to face the interior 912 of the pouch 904, as shown in FIG. 9A. In this example, the microwave interactive web or structure 910 comprises a substantially continuously repeated pattern of spaced foil segments 914 (schematically shown by heavier stippling in FIGS. 9B-9D) superposed with and at least partially joined to a susceptor film 916. The susceptor film 916 includes a layer of microwave energy interactive material 918

Figure 9C:
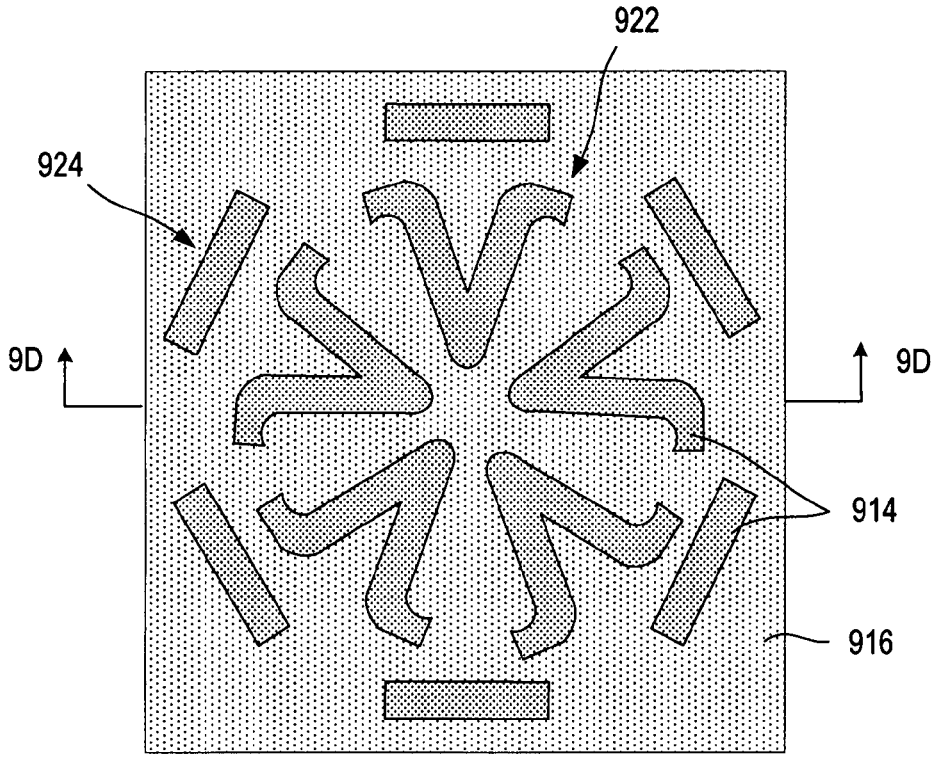
FIG. 9C is an enlarged, schematic top plan view of a portion of the microwave energy interactive card of FIGS. 9A and 9B.
Figure 9D:
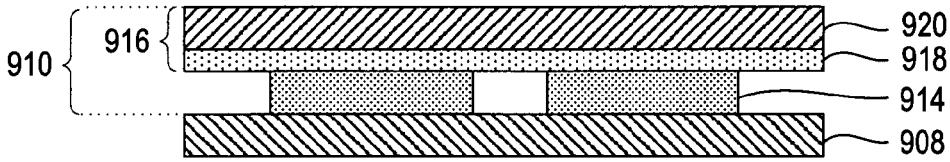
FIG. 9D is a schematic cross-sectional view of the portion of the microwave energy interactive card shown in FIG. 9C, taken along a line 9D-9D.

(schematically shown by lighter stippling in FIGS. 9B-9D) supported on a microwave energy transparent substrate 920, as discussed above with the various other exemplary embodiments, and as shown schematically in FIGS. 9C and 9D. Other layers may be present in the structure 910, as will be understood by those of skill in the art. For example, one or more adhesive layers, one or more etch-resistant layers, and so forth, may be included.

As best seen in FIG. 9C, in which a single "repeat unit" of the pattern of foil segments 914 is shown schematically in plan view and cross-sectional view, a first set of metallic segments 922 defines a five-lobed flower shape that promotes uniform distribution of microwave energy to an adjacent food item (not shown) by distributing energy from its perimeter to its center. A second set of spaced apart, substantially rectangular metallic segments 924 is positioned around each five-lobe flower shape 922 in a somewhat hexagonal configuration. While an exemplary combination of metallic foil segments with a susceptor element is provided herein, it will be understood that numerous other patterns may be used in accordance with the present invention. Examples of patterns that may be suitable include, but are not limited to, those described in and/or contemplated by U.S. Pat. Nos. 6,204,492, 6,433,322, 6,552,315, and 6,677,563, each which is incorporated by reference herein in its entirety. In use, the various microwave energy interactive elements, namely the segmented metal foil 914 and the susceptor 916, work in concert to provide even heating, browning, and/or crisping of the food item in intimate or proximate contact therewith.

Figure 9F:
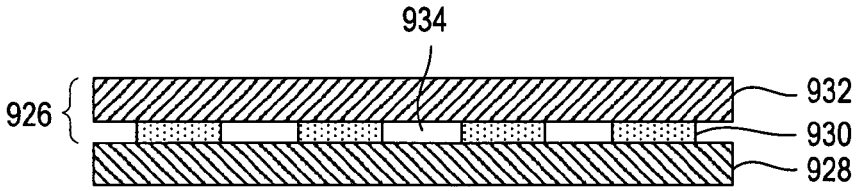
FIG. 9F is an enlarged, schematic cross-sectional view of a portion of the microwave energy interactive wrapper or pouch shown in FIG. 9E.
Figure 9E:
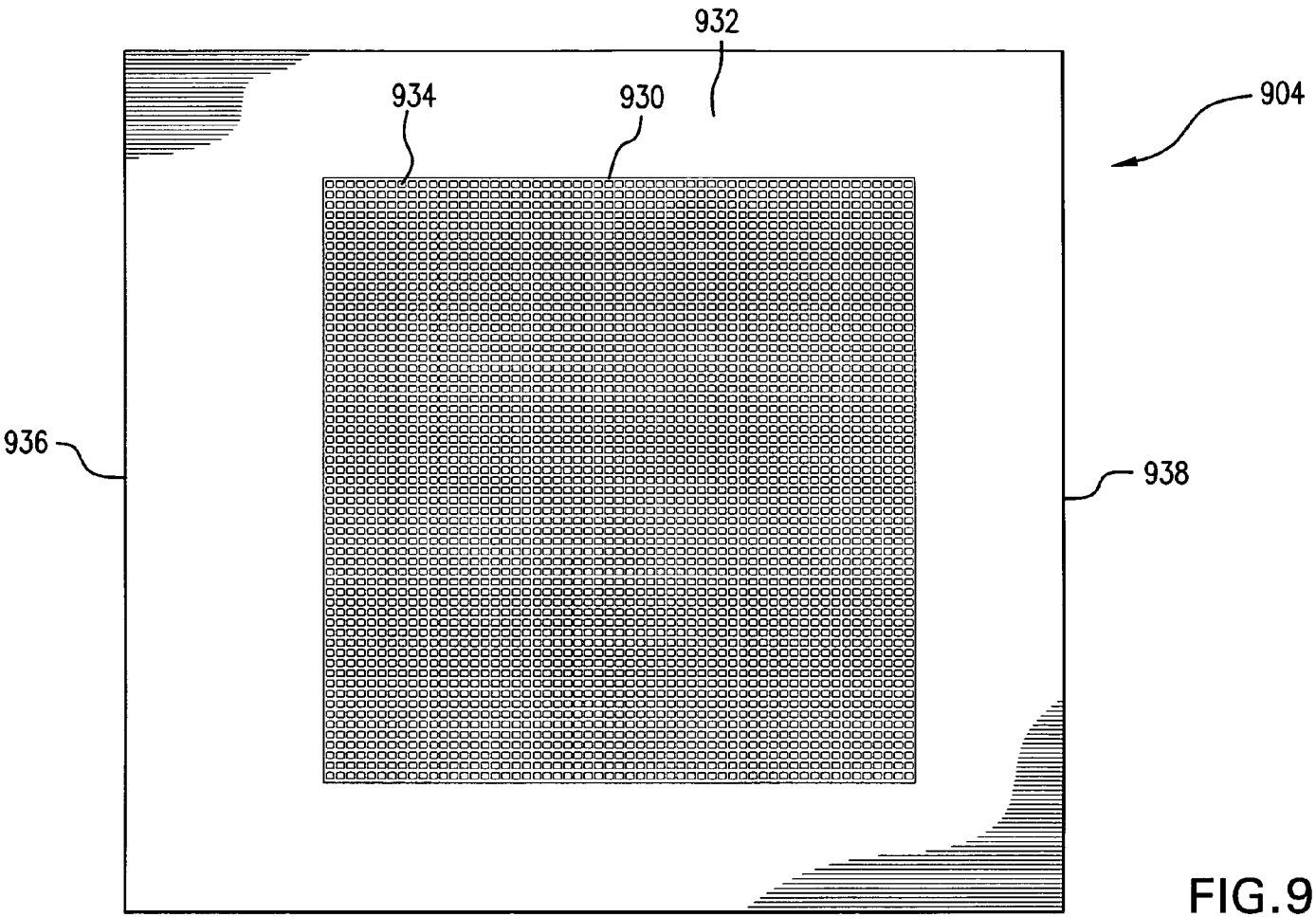
FIG. 9E is an isolated, schematic top plan view of the interior surface of the pouch or wrapper of FIG. 9A, with the pouch or wrapper in a fully open, flattened configuration.

FIG. 9E depicts the pouch 904 shown in FIG. 9A in an unfolded condition, resembling a wrapper. The pouch 904 generally may be formed from any flexible material capable of conforming to the shape of a food item (not shown) seated on the card 902. In this particular example, the pouch 904 is formed from a material comprising a susceptor film 926 overlying and at least partially joined to a flexible support 928. The susceptor film 926 comprises a patterned layer of microwave energy interactive material 930 supported on a polymer film 932, as shown in schematic cross-sectional view in FIG. 9F. The overall pattern resembles a grid or mesh of microwave energy interactive material 930 with a plurality of substantially squared shaped microwave energy transparent areas 934 therebetween. In this and other aspects of the invention, the transparent areas 934 may be created by selectively applying the microwave interactive material to other areas, selectively removing the microwave interactive material, selectively deactivating the microwave interactive material, or using any other suitable technique. Examples of such methods and processes are provided above. In this example, the patterned susceptor 930 is disposed in a substantially central area of the unfolded pouch 904. However, other configurations are contemplated hereby.

To form the pouch 904, opposed ends 936 and 938 are brought together, overlapped, and joined in any suitable manner to form a pouch 904, or may be left partially unsealed for use as a wrapper. The food item (not shown) is placed on the card 902, with the overlapped, unmetallized portions of the pouch 904 being in a superposed, at least partially contacting relationship with the card 902. When the package 900 is in use, the top and side surfaces of the food item (not shown) are heated, browned, and/or crisped by the grid-like susceptor 930 on the pouch 904, and the bottom of the food item is heated, browned, and/or crisped by microwave interactive elements 914 and 916 on the card 902. However, it is contemplated that the pouch may include one or more microwave energy interactive elements superposed with the elements on the card to enhance further the heating, browning, and/or crisping of the bottom of the food item.

If desired, the pouch 904 may include pleats, gussets 940, or other features to accommodate the dimensions of the food item, as shown in FIG. 9A. As will be understood by those of skill in the art, the wrapper also may include one or more features to facilitate opening and/or sealing of the wrapper.

Figure 10A:
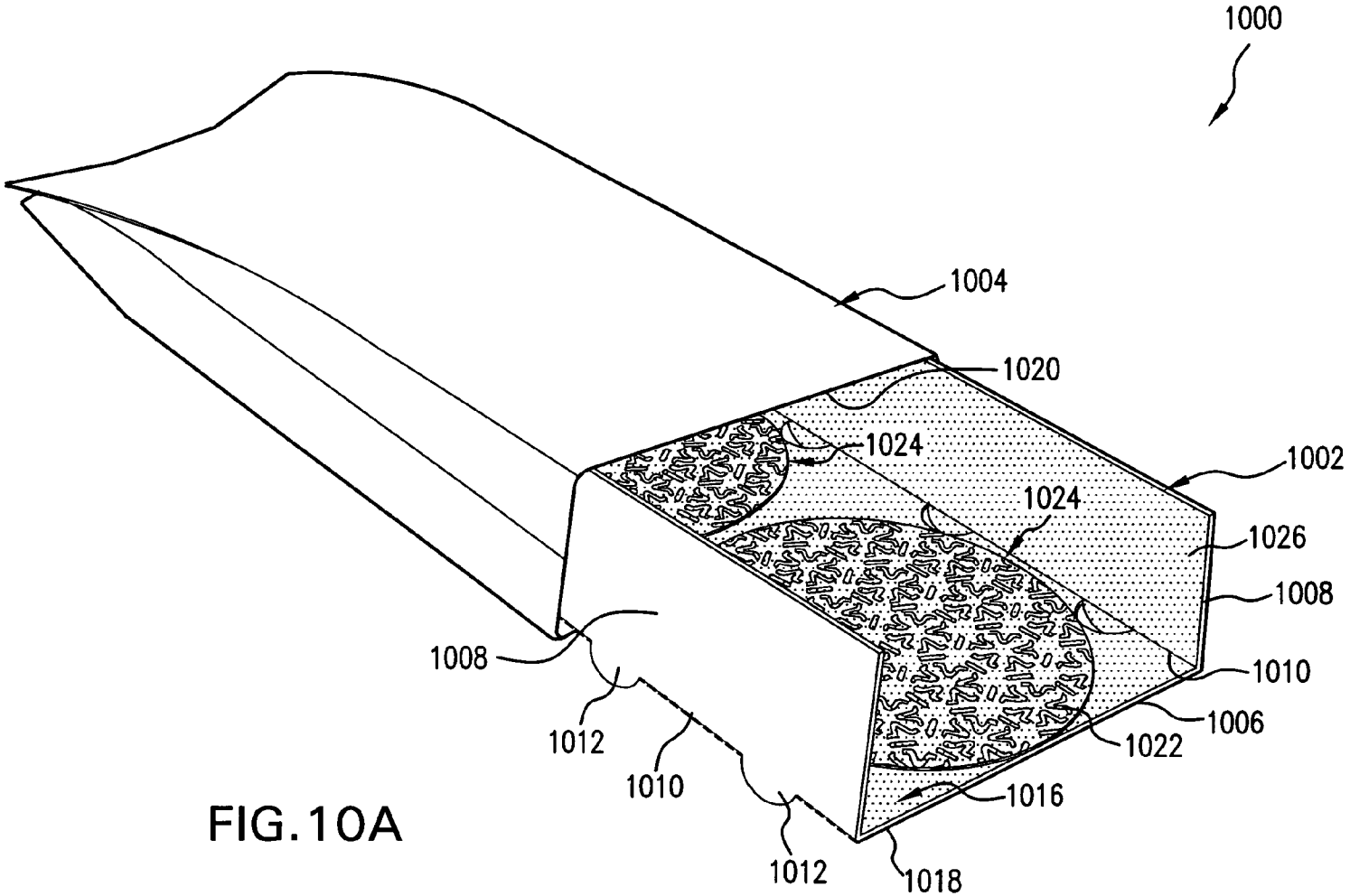
FIG. 10A schematically depicts another exemplary package according to various aspects of the present invention, including a microwave energy interactive card with side walls and a microwave energy interactive pouch or wrapper.
Figure 10B:
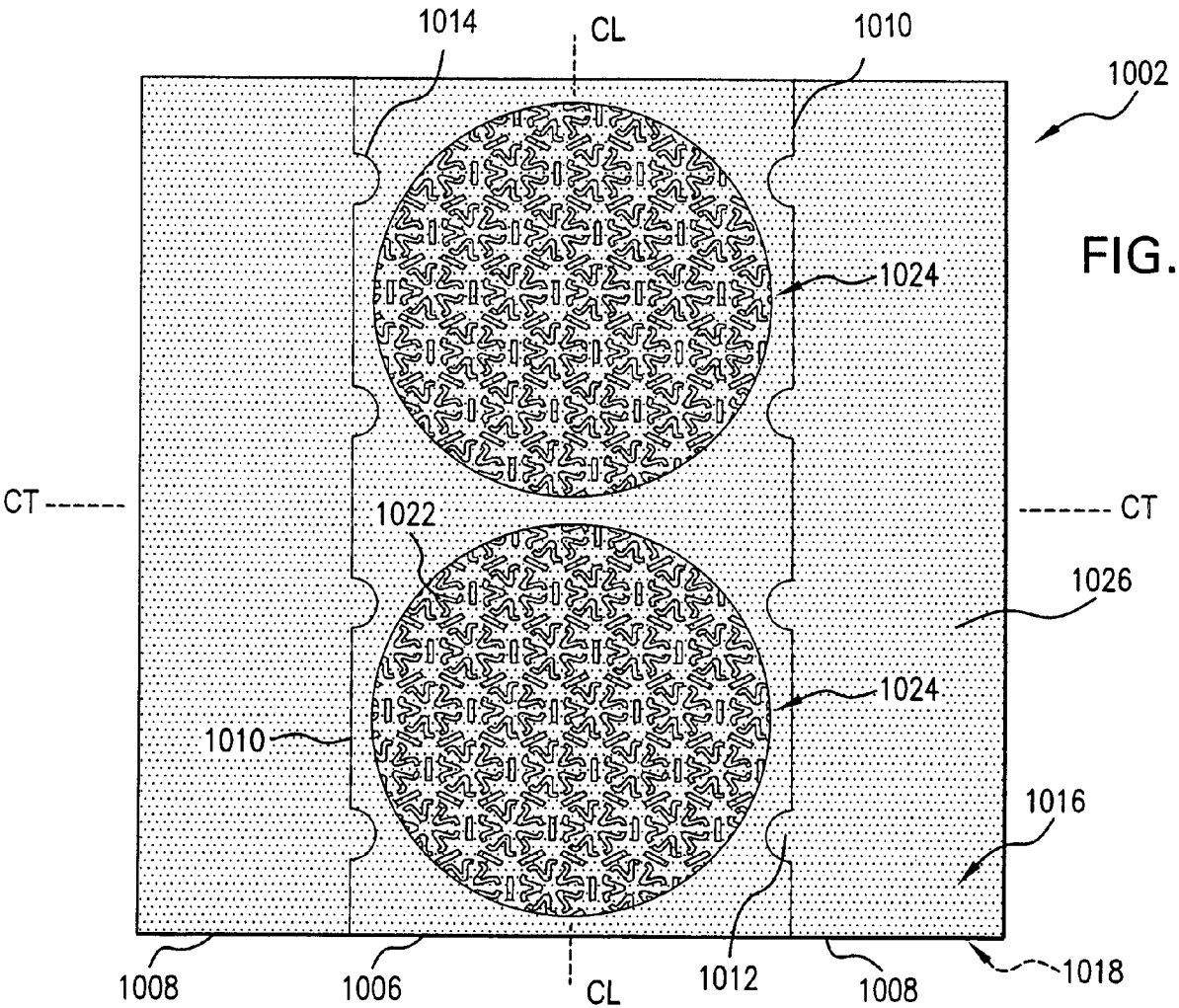
FIG. 10B is an isolated, schematic top plan view of the microwave energy interactive card of FIG. 10A, in an open, flattened configuration.
Figure 10C:
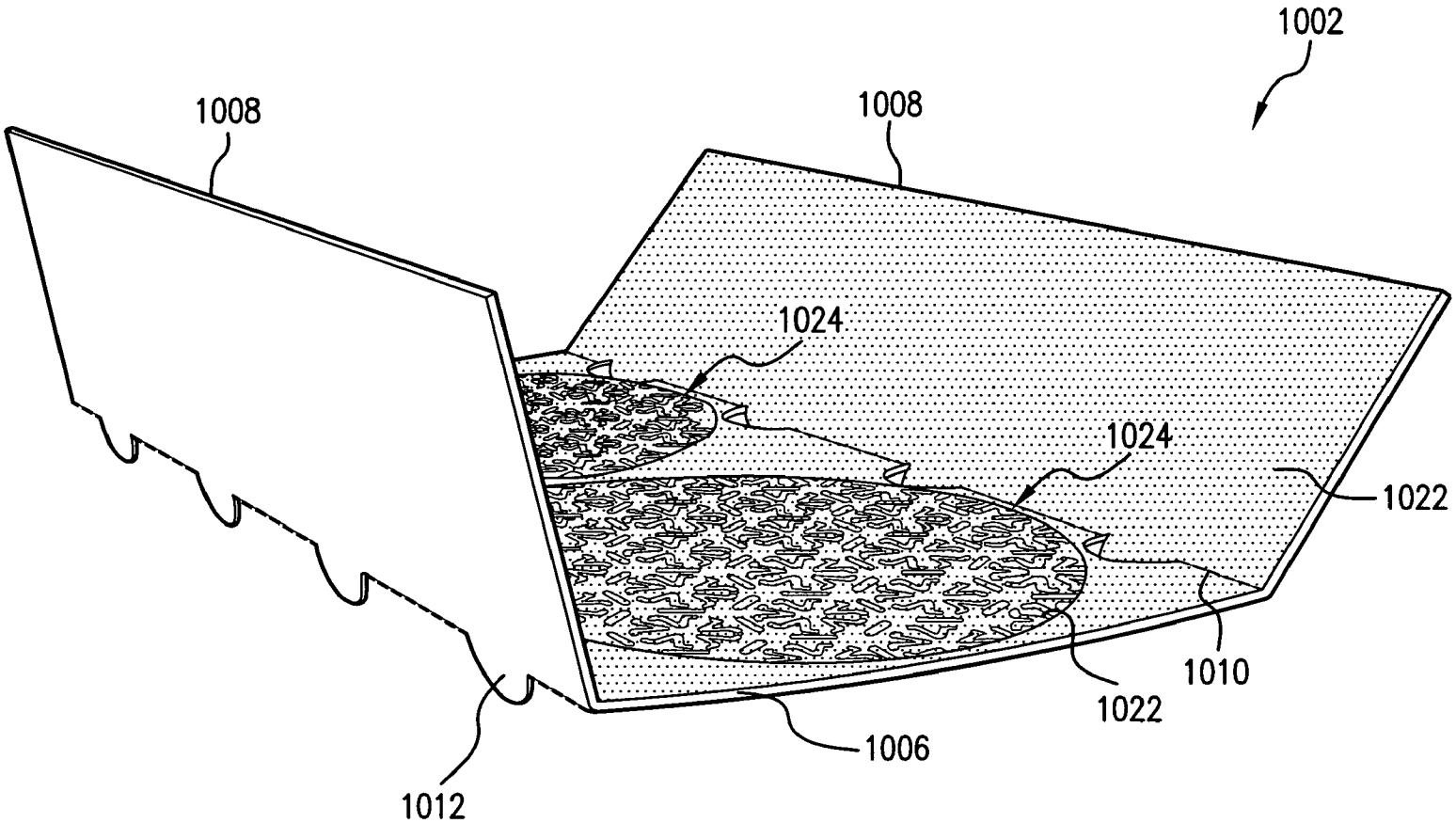
FIG. 10C schematically depicts the microwave energy interactive card of FIGS. 10A and 10B, in a partially folded configuration.

FIGS. 10A-10C depict yet another exemplary package 1000 according to various aspects of the present invention. As shown in FIG. 10A, the package 1000 includes a dimensionally stable, rigid or semi-rigid, somewhat U-shaped platform 1002 dimensioned to be received within a flexible pouch 1004 or other flexible wrapper. The pouch 1004 may be substantially similar to that described in connection with FIGS. 9E and 9F, or may be any other suitable pouch or wrapper described herein or contemplated hereby, and is not described in detail in connection with FIGS. 10A-10C.

FIG. 10B illustrates the platform 1002 in an unfolded, flattened configuration (sometimes referred to as a "blank"). The platform blank 1002 is substantially symmetrical along a longitudinal centerline CL and a transverse centerline CT.

The platform 1002 includes a centrally disposed base panel 1006 and a pair of side panels 1008 joined along respective longitudinal fold lines 1010. If desired, fold lines 1010 may include a plurality of weakening perforations, linear or angled cuts or score lines, kiss cut lines, or other tear lines as desired that define elevating "feet" or support elements. In this example, the platform 1002 includes four pairs of support elements 1012 defined by respectively opposed arcuate cut lines 1014 initiating, extending through respective side panels 1008, and terminating along respective fold lines 1010. While arcuate cut lines are shown herein, other cut line shapes are contemplated hereby. For example, the support elements may be square, rectangular, or any other regular or irregular shape.

If desired, the platform 1002 may include a microwave interactive web 1016 comprising a plurality of microwave energy interactive elements (shown by stippling in FIGS. 10A-10C) overlying and at least partially joined to at least a portion of a dimensionally support 1018 (hidden from view, indicated in FIG. 10B with a dashed line) in a superposed, contacting relationship. In this example, the microwave interactive web 1016 comprises a plurality of metallic foil segments 1022 (or "segmented metal foil") arranged in two substantially circular groups 1024 overlying a substantially continuous susceptor 1026, with the foil segment groups 1024 being positioned to overlie at least a portion of the base panel 1006. The particular arrangement of foil segments is similar to that shown in FIGS. 9B-9D, and thus is not described in further detail in connection with FIGS. 10A-10C. However, numerous other arrangements and configurations are contemplated hereby.

To prepare the platform 1002 for use, panels 1008 are folded along fold lines 1010 to create generally upstanding walls with the microwave interactive web 1016 facing the interior 1020 of the pouch 1004, as shown in FIGS. 10A and 10C. By doing so, the support elements 1012 are struck from the base panel 1006 and brought into a generally upright configuration, thereby elevating the base panel 1006 from the interior surface 1028 of the pouch 1004 on which the platform 1002 is seated (FIG. 10A).

In this configuration, the susceptor 1026 overlying the upstanding panels or walls 1008 of the platform 1002 is in a superposed, overlapping relationship with the susceptor or other microwave energy interactive element overlying at least a portion of the pouch 1006 (e.g., the grid-like microwave energy interactive susceptor element shown in FIGS. 9E and 9F), as generally illustrated in FIG. 10A. By configuring the microwave interactive elements 1026 and 1030 in this manner, the sides of a food item (not shown) heated therein are heated, browned, and/or crisped to a greater extent than would be achieved with microwave energy interactive element alone. In contrast, the browning and/or crisping of the bottom of the food item is achieved primarily by microwave energy interactive elements 1022 and 1026 disposed on the base panel 1006 of the microwave energy interactive platform 1002. However, it is contemplated that the pouch 1004 may include a microwave energy interactive element in a superposed arrangement with the base panel 1006 of the platform 1002, and that such a superposed arrangement may enhance heating, browning, and or crisping of the bottom of the food item.

Turning now to FIGS. 11A-11D, still another exemplary package 1100 is provided. The package 1100 includes a dimensionally stable microwave energy interactive sleeve 1102 for receiving a food item therein, and a somewhat flexible microwave energy interactive pouch 1104 dimensioned to receive the sleeve 1102. In this example, the pouch 1104 may be substantially similar to that described in connection with FIGS. 9E and 9F, and is not discussed further herein. Other pouches and wrappers are contemplated hereby.

Figure 11A:
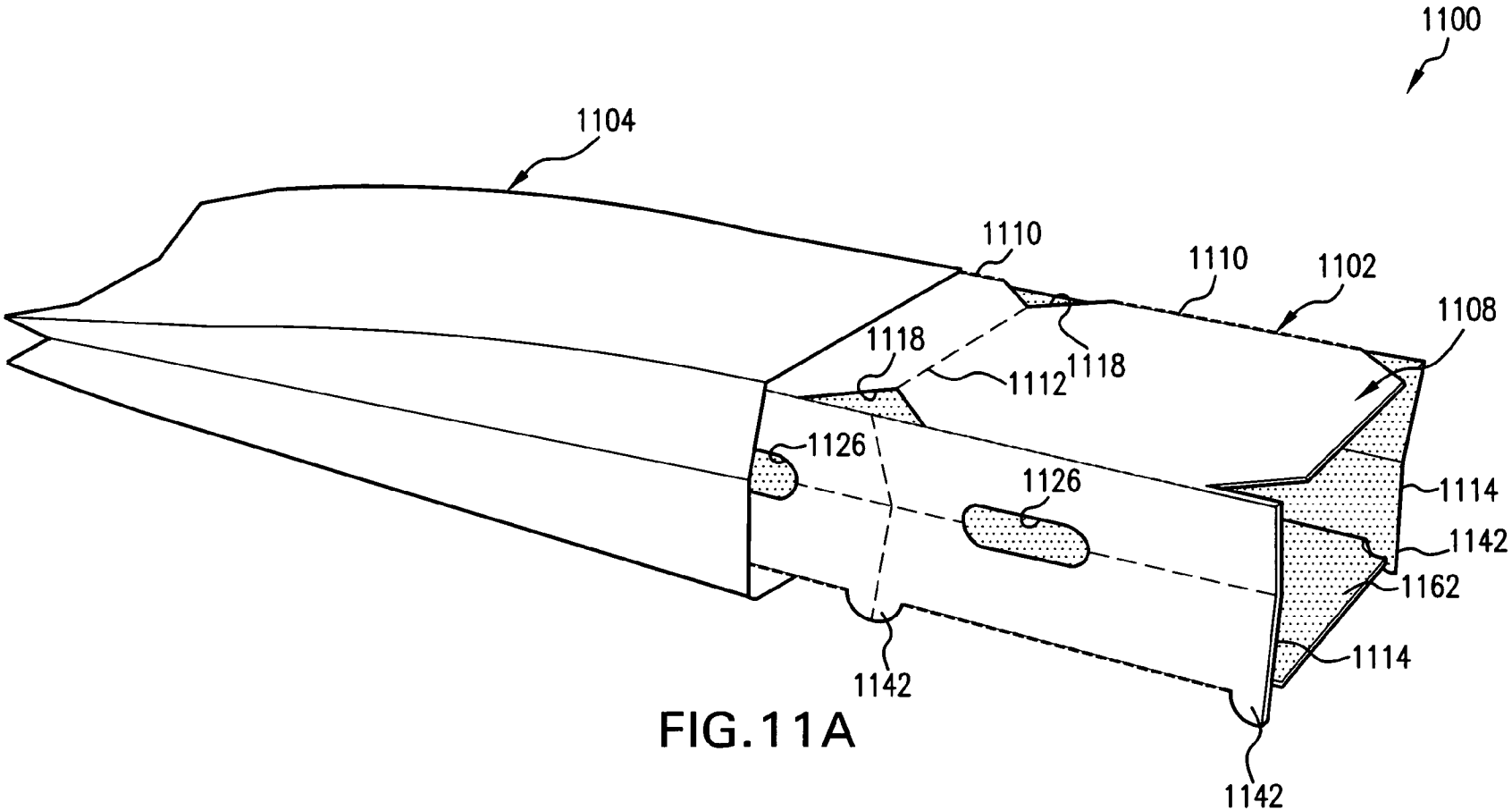
FIG. 11A schematically depicts still another exemplary package according to various aspects of the present invention, including a microwave energy interactive sleeve and microwave energy interactive pouch or wrapper.
Figure 11B:
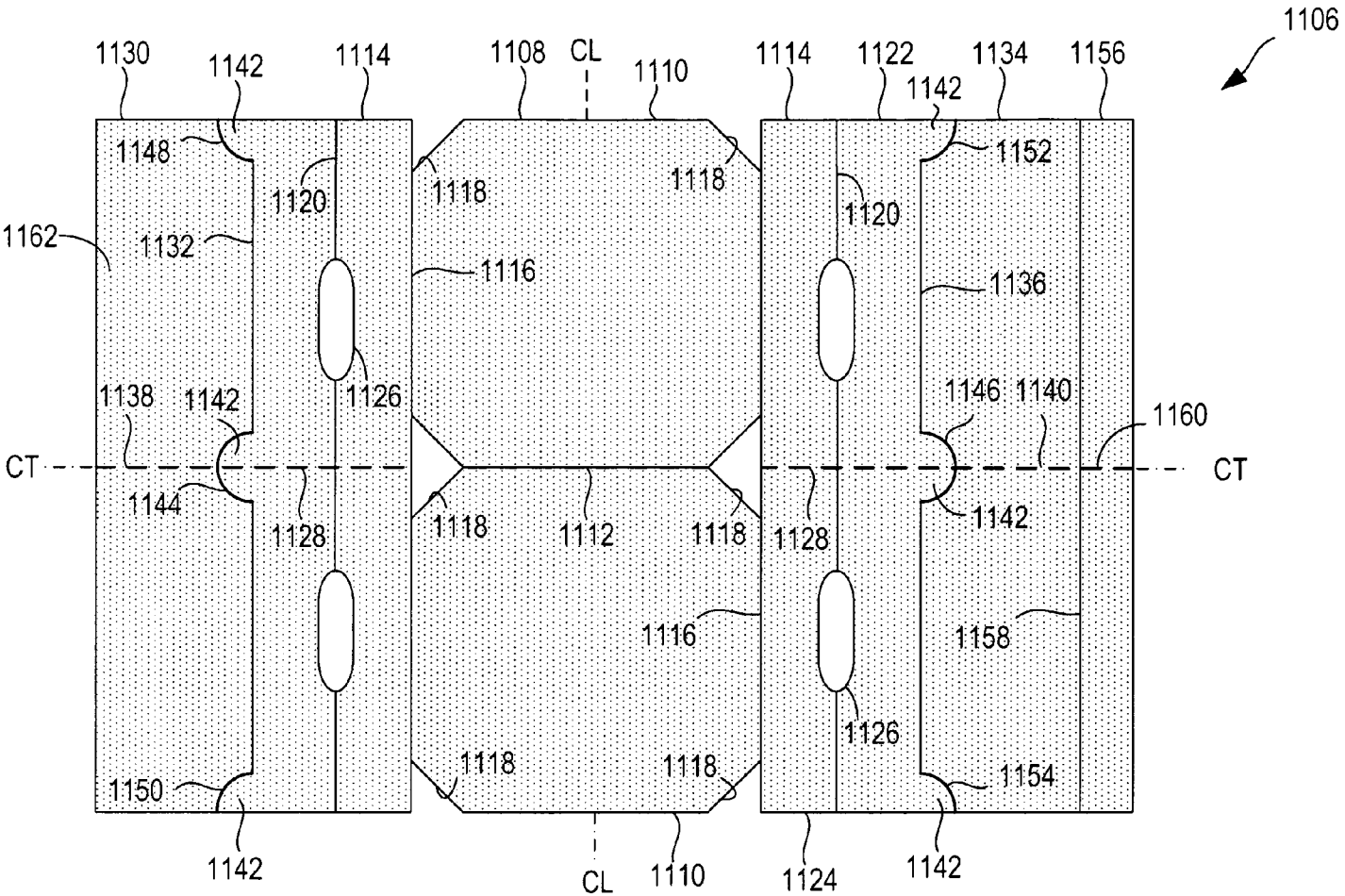
FIG. 11B is a schematic top plan view of a blank used to form the microwave energy interactive sleeve of FIG. 11A.

FIG. 11B depicts an exemplary blank 1106 that may be used to form the sleeve 1102 according to various aspects of the invention. The blank 1106 is generally symmetrical along a transverse centerline CT and some portions also are generally symmetrical along a longitudinal centerline CL.

The blank 1106 includes a first or top panel 1108 comprising a pair of somewhat octagonal sections 1110 joined along a tear line 1112. A pair of side panels or minor panels 1114 extend from the first panel 1108 along respective longitudinal fold lines 1116, which are interrupted by a plurality of somewhat triangular shaped cutouts 1118 that provide ventilation to a food item being heated therein (not shown). While a particular number, shape, and configuration of such cutouts is provided herein, it will be understood that numerous variations are contemplated hereby.

Side panels 1114 each include a substantially centrally located longitudinal fold line 1120 that extends between opposed edges 1122 and 1124 of the blank 1106, substantially parallel to fold lines 1116 and 1120. Optionally, side panels 1114 also include a pair of somewhat obround apertures 1126 substantially centered across respective fold lines 1120 in a spaced apart configuration. As used herein, the term "obround" refers to a shape consisting of two semicircles connected by parallel lines tangent to their endpoints. Other aperture shapes are contemplated hereby. Further, side panels 1114 optionally each include a transverse tear line 1128 substantially aligned with tear line 1112 in the top panel 1108.

Still viewing FIG. 11B, a first end panel 1130 (or "first bottom panel portion") extends from one side panel 1114 along a longitudinal fold line 1132. A second end panel 1134 (or "second bottom panel portion") extends from the other side panel 1114 along a longitudinal fold line 1136. The first bottom panel portion 1130 and the second bottom panel portion 1134 each include a respective transverse tear line 1138 and 1140 substantially aligned with respective tear lines 1128 in the side panels 1114 and tear line 1112 in the top panel 1108.

Optionally, fold lines 1132 and 1136 may include a plurality of weakening perforations, linear or angled cuts or score lines, kiss cut lines, or other tear lines that define elevating "feet" or other support elements 1142. In this example, a plurality of support elements 1142 are defined by arcuate cut lines or slits 1144 and 1146 that interrupt fold lines 1132 and 1136. Slit 1144 initiates substantially at fold line 1132, extends through a portion of panel 1130, and terminates substantially at fold line 1132. Similarly, slit 1146 initiates substantially at fold line 1136, extends through a portion of panel 1134, and terminates substantially at fold line 1136. Additional support elements 1142 are defined by an arcuate slit 1148 extending substantially between fold line 1132 and edge 1122, an arcuate slit 1150 extending substantially between fold line 1132 and edge 1124, an arcuate slit 1152 extending substantially between fold line 1136 and edge 1122, and an arcuate slit 1154 extending substantially between fold line 1136 and edge 1124. While arcuate cut lines are shown herein, other cut line shapes are contemplated hereby. For example, the support elements may be square, rectangular, or any other regular or irregular shape.

A glue flap 1156 extends from the second bottom panel portion 1134 along a longitudinal score line 1158. Transverse tear line 1160 is substantially coterminous with tear line 1140.

A microwave interactive element 1162 (schematically shown by stippling), in this example, a susceptor optionally supported on a polymer film, overlies a substantial portion of each of the various panels 1108, 1114, 1130, 1134, and 1156 of the blank 1106.

Figure 11C:
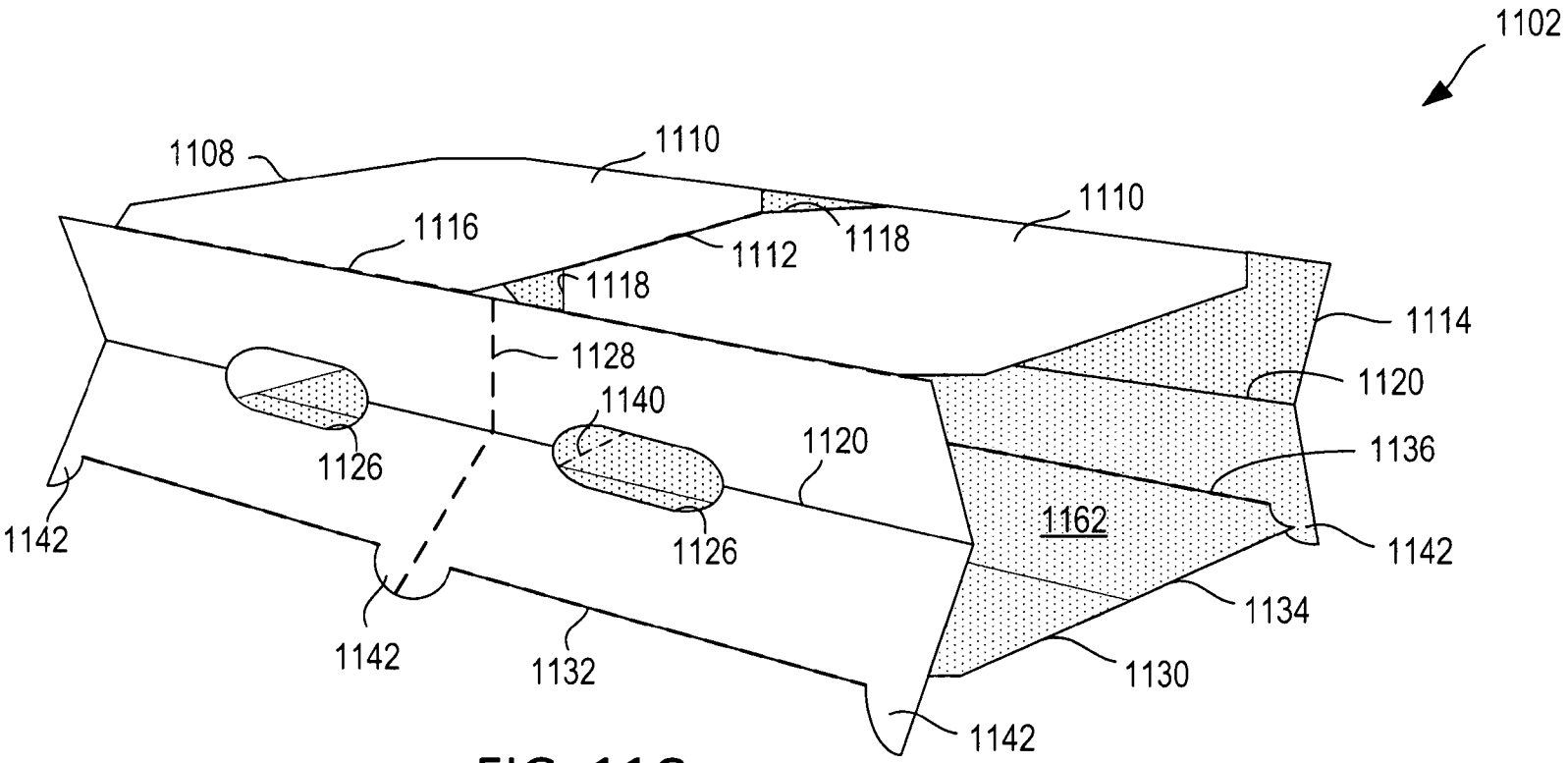
FIG. 11C schematically depicts the sleeve of FIG. 11A, formed from the blank of FIG. 11B.
Figure 11D:
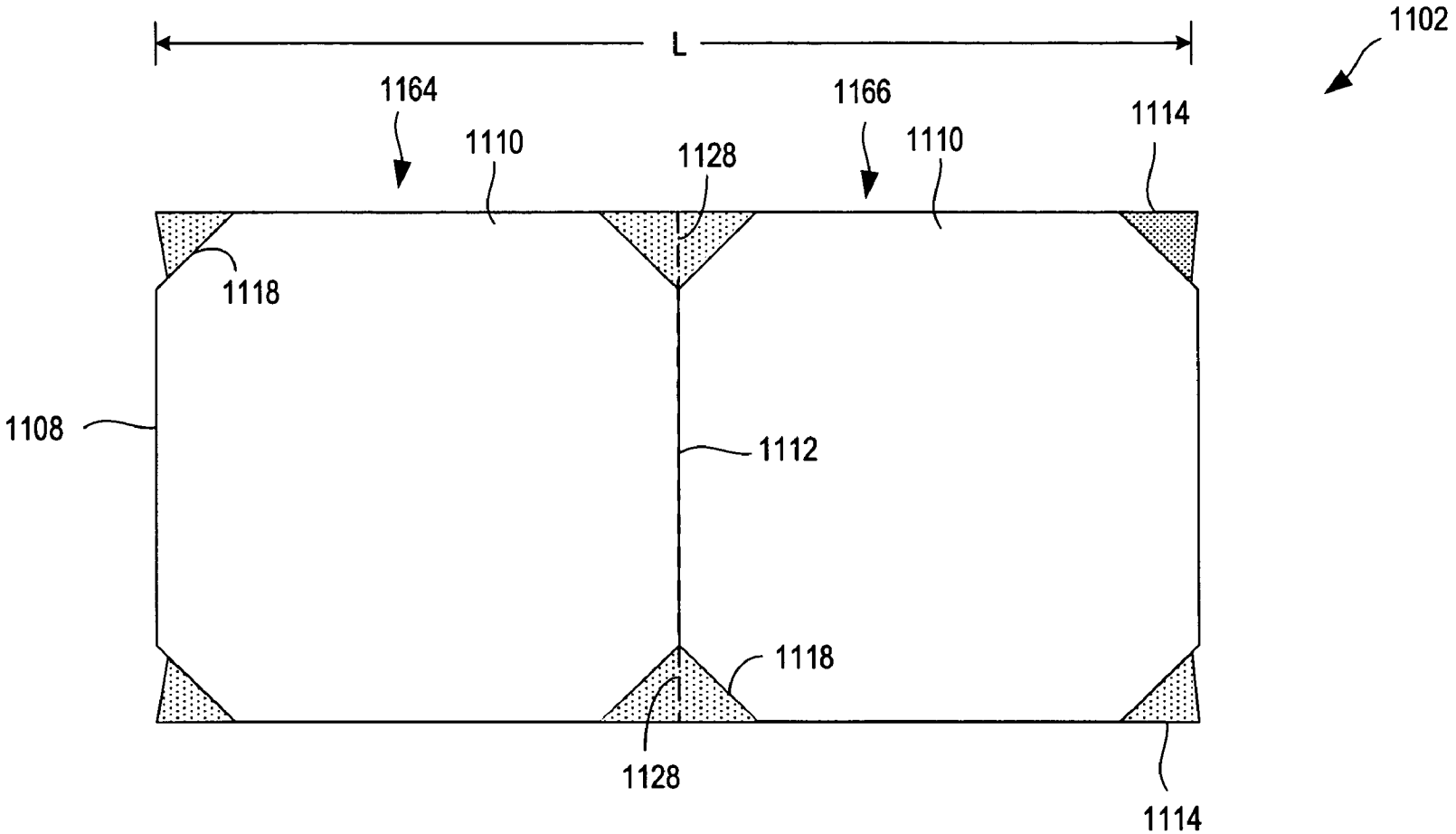
FIG. 11D is an isolated, schematic top plan view of the sleeve of FIGS. 11A and 11C, which is formed from the blank of FIG. 11B.

Generally described, to assemble the blank 1106 into a sleeve 1104, as shown in FIGS. 11A, 11C, and 11D, panels 1130, 1114, 1108, and 1134 are folded along respective fold lines 1132, 1116, and 1136 and brought towards each other so that glue flap 1156 overlaps at least partially with, and can be adhered to, the first bottom panel portion 1130. The sleeve 1104 then can be inverted such that panels 1130 and 1134 collectively serve as a bottom panel or base of the sleeve 1104. In this configuration, tear lines 1138, 1128, 1112, and 1140 are aligned substantially to form a functionally coterminous tear line around the sleeve 1104, such that the sleeve 1104 can be separated into two sleeve segments 1164 and 1166, each having a length of about one-half of the total length L of sleeve 1104, as best illustrated in FIG. 11D. Such a feature may be useful where, for example, the sleeve 1104 contains multiple food items or servings, with each segment 1164 and 1166 containing a single food item or serving, for example, a biscuit or sandwich. In such an instance, it may be beneficial to be able to separate the two segments 1164 and 1166 along tear lines 1138, 1128, 1112, and 1140 so that more than one consumer can transport the respective portion before or after heating the food item in the pouch 1102. While the segments 1164 and 1166 are shown as having approximately equal lengths, it is contemplated that two or more segments having the same or different lengths may be provided.

Figure 12:
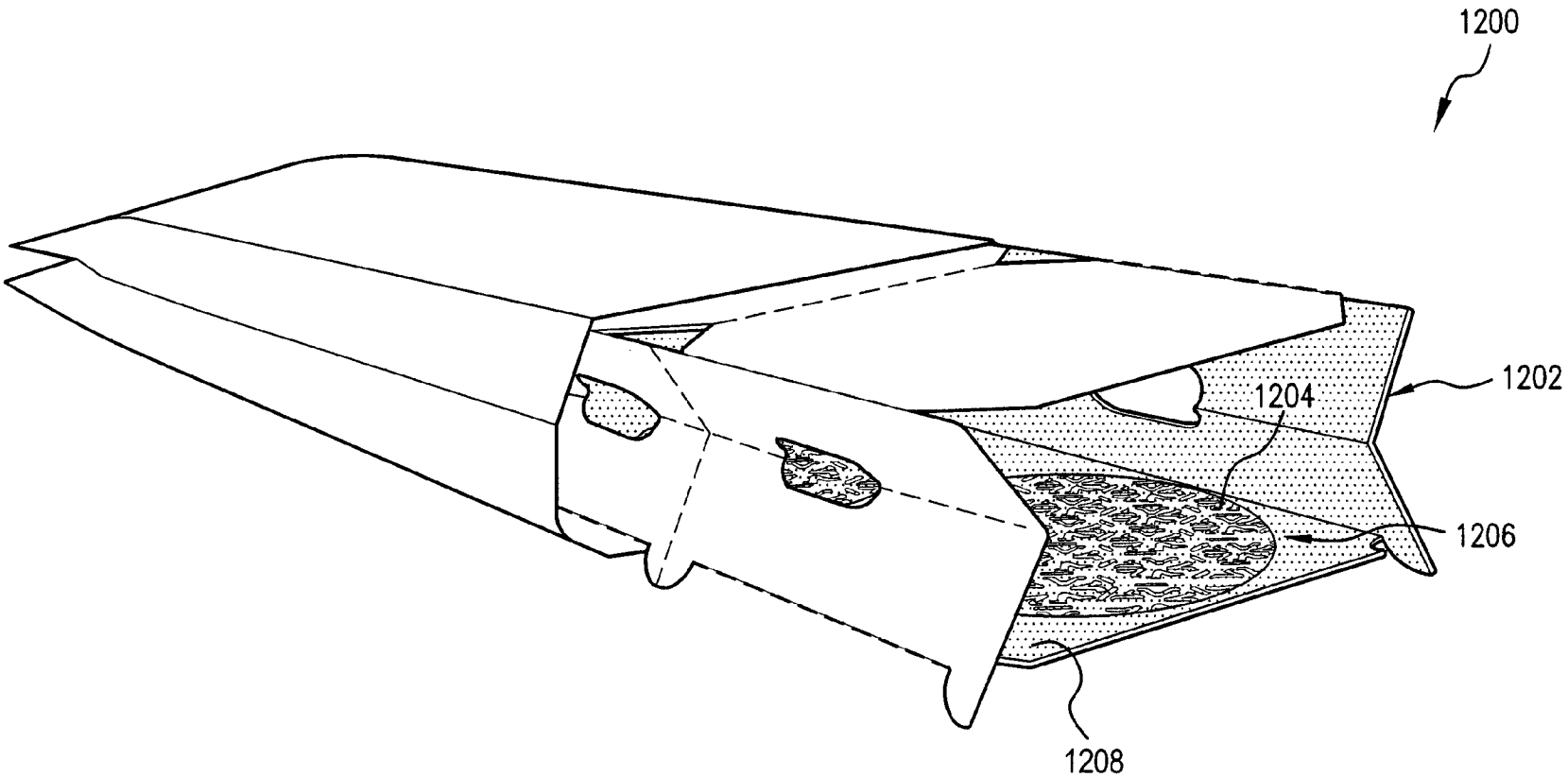
FIG. 12 schematically depicts another exemplary package according to various aspects of the present invention, including a microwave energy interactive sleeve and a microwave energy interactive pouch or wrapper.

FIG. 12 presents another exemplary package 1200 according to various aspects of the invention. In this example, the package 1200 is substantially similar to the package 1100 of FIGS. 11A-11D, except that the dimensionally stable sleeve 1202 includes a pattern of foil segments 1204 arranged in two substantially circular regions 1206 overlying a susceptor 1208, similar to that shown in FIGS. 9B-9D.

In this and other aspects of the invention, the package may be provided to the user in a variety of ways. For example, the food item may be seated on the card, tray, or sleeve within the wrapper or pouch, with the wrapper or pouch being sealed at its ends using an adhesive, thermal bonding, mechanical bonding, ultrasonic bonding, or any other suitable technique. Depending on the particular application, the user may be instructed to open one or both ends of the wrapper or pouch before heating to provide ventilation to the food item, and/or to allow the wrapper to expand or move freely during heating. Alternatively, the food item may be seated on the card, tray, or sleeve within the wrapper or pouch, with both contained within a removable overwrapping material formed from, for example, a barrier material. As still another example, the food item may be contained in a separate wrapping material (not shown) from which it is removed and placed in card, tray, or sleeve and into the wrapper or pouch prior to heating.

Optionally, one or more portions of the various blanks, supports, packages, or other constructs described herein or contemplated hereby may be coated with varnish, clay, or other materials, either alone or in combination. The coating may then be printed over with product advertising or other information or images. The blanks, supports, packages, or other constructs also may be coated to protect any information printed thereon.

Furthermore, the blanks, supports, packages, or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6, and others referred to above.

Alternatively or additionally, any of the blanks, supports, packages, or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, U.S. Patent Application Publication No. US 2006/0049190 A1, and U.S. Patent Application Publication No. US 2007/0145045 A1, each of which is incorporated herein by reference in its entirety. Additionally, the blanks, supports, packages, or other constructs may include graphics or indicia printed thereon.

It will be understood that with some combinations of elements and materials, the microwave interactive element may have a grey or silver color this is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

In the examples shown herein, the various constructs are somewhat rectangular in shape, suitable, for example, for heating one or more sandwiches, biscuits, or other dough-based food item therein. However, it will be understood that in this and other aspects of the invention described herein or contemplated hereby, numerous suitable shapes and configurations may be used to form the various panels and other components of the various constructs. Examples of other shapes encompassed hereby include, but are not limited to, polygons, circles, ovals, cylinders, prisms, spheres, polyhedrons, and ellipsoids. The shape of each panel or other component may be determined largely by the shape of the food item, and it should be understood that different packages are contemplated for different food items, for example, sandwiches, pizzas, breaded chicken nuggets or strips, egg rolls, French fries, soft pretzels, pizza bites, cheese sticks, pastries, doughs, and so forth. Likewise, the construct may include gussets, pleats, or any other feature needed or desired to accommodate a particular food item and/or portion size. Additionally, it will be understood that the present invention contemplates blanks and constructs for single-serving portions and for multiple-serving portions.

It also will be understood that in each of the various blanks and constructs described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness, a cut that extends partially into a material along the desired line of weakness, and/or a series of cuts that extend partially into and/or completely through the material along the desired line of weakness; and various combinations of these features.

For example, one type of conventional tear line is in the form of a series of cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. Such a tear line that includes nicks also can be referred to as a "cut line", since the nicks typically are a relatively small percentage of the subject line, and alternatively, the nicks can be omitted from such a cut line. Where nicks are present in a cut line (e.g., tear line), typically the nicks will not be overly large or overly numerous in a manner that might cause a reasonable user to consider incorrectly the subject line to be a fold line.

It is understood that various features described herein, such as lines, panels, and other features, include endpoints, edges, peripheral areas, central areas, corners, and the like, as appropriate. Various exemplary blanks and constructs are shown and/or described herein as having fold lines, tear lines, score lines, cut lines, kiss cut lines, and other lines extending from a particular feature to another particular feature, for example, from one particular panel to another or from one particular edge to another, or are described as being coterminous with one another. However, it will be understood that such lines need not necessarily extend to or between such features in a precise manner. Instead, such lines may generally extend between the various features as needed to achieve the objective of such line. For example, where a particular tear line is shown as extending from a first edge of a blank to another edge of the blank, the tear line need not extend completely to one or both of such edges. Rather, the tear line need only extend to a location sufficiently proximate to the edge so that the tear line is operative without causing undesirable damage to the blank. As another example, where a particular tear line is said to be coterminous with another tear line, the tear lines need not extend completely to one another. Rather, the endpoint of each tear line need only extend to a location sufficiently proximate to the other such that the tear lines are substantially coterminous or "operatively coterminous" or "functionally coterminous", that is, the tear lines are capable of functioning as a coterminous or continuous tear line even though there is some distance between them. Thus, use of the term "coterminous" herein refers to lines or other features that are substantially coterminous or operatively coterminous.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention. While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention as set forth in the appended claims.

What is claimed is:

1. A microwave heating package comprising:

a dimensionally stable sleeve including a pair of major panels and a pair of minor panels defining an interior space for receiving a food item, the major panels and the minor panels each having a longitudinal dimension extending in a longitudinal direction and a transverse dimension extending in a transverse direction, the minor panels being joined to the major panels along fold lines extending in the longitudinal direction, wherein the sleeve includes a tear line extending in the transverse direction across each of the major panels and the minor panels, the tear line substantially bisecting the sleeve in the longitudinal direction into a first segment and a second segment, the first segment and the second segment each being substantially octagonal in shape; and a flexible component adapted to receive the sleeve, wherein the sleeve and the flexible component each include microwave energy interactive material, the microwave energy interactive material being operative as a susceptor.

2. The microwave heating package of claim 1, wherein the first segment and the second segment are adapted to be separated from one another along the tear line.

3. The microwave heating package of claim 1, wherein the microwave energy interactive material of the sleeve further comprises a segmented metal foil overlying at least a portion of at least one of the major panels of the sleeve.

4. The microwave heating package of claim 1, further comprising a plurality of support elements extending downwardly from the minor panels.

5. The microwave heating package of claim 4, wherein each of the support elements is defined by a slit that initiates and terminates along one of the fold lines extending in the longitudinal direction.

6. The microwave heating package of claim 1, wherein the microwave energy interactive material of the flexible component is arranged in a grid-like configuration.

7. The microwave heating package of claim 1, wherein the microwave energy interactive material of the flexible component circumscribes a plurality of microwave energy transparent areas.

8. A blank for forming a dimensionally stable construct for heating, browning, and/or crisping a food item in a microwave oven, comprising:

a first panel having a longitudinal dimension extending in a longitudinal direction and a transverse dimension extending in a transverse direction, the first panel including a first segment and a second segment joined along a transverse tear line, the first segment and second segment each being substantially octagonal in shape;

a pair of opposed side panels joined to the first panel along respective longitudinal fold lines, the side panels each including a transverse tear line substantially aligned with the transverse tear line in the first panel;

a pair of opposed end panels joined to the side panels along respective longitudinal fold lines, the side panels each including a transverse tear line substantially aligned with the transverse tear lines in the first panel and the side panels; and a microwave energy interactive element overlying at least one the first panel, the side panels, and the end panels.

9. The blank of claim 8, further comprising a plurality of cut lines initiating and terminating along the longitudinal fold line joining each side panel to the respective end panel.

10. The blank of claim 8, further comprising a glue flap extending from at least one of the opposed end panels.

11. The blank of claim 8, further comprising at least one aperture extending though at least one of the side panels.

12. The blank of claim 8, wherein the microwave energy interactive element comprises a susceptor, a segmented metal foil, a metal foil, or any combination thereof.

13. A microwave heating package, comprising:

a dimensionally stable platform for receiving a food item, the platform including a base and a pair of walls opposite one another, the base including microwave energy interactive material, wherein the platform defines at least a portion of a sleeve, the sleeve including a top panel joined to the pair of walls opposite the base, wherein at least one of the top panel and walls includes microwave energy interactive material, and wherein the sleeve includes a tear line extending around the sleeve, the tear line substantially bisecting the base, walls, and top panel, wherein the tear line substantially bisects the top panel into a first section and second section, the first section and the second section of the top panel each being substantially octagonal in shape; and a flexible component dimensioned to receive the platform, the flexible component including microwave energy interactive material, wherein the microwave energy interactive material of the base and the microwave energy interactive material of the flexible component are configured for being in a superposed configuration beneath the food item.

14. The microwave heating package of claim 13, wherein the microwave energy interactive material of the flexible component is further configured for overlying the food item.

15. The microwave heating package of claim 13, wherein the microwave energy interactive material of at least one of the base and the flexible component is operative for converting at least a portion of impinging microwave energy into thermal energy.

16. The microwave heating package of claim 13, wherein the microwave energy interactive material of the base comprises a plurality of metal foil segments.

17. The microwave heating package of claim 16, wherein the metal foil segments are arranged as a pair of substantially circular groups.

18. The microwave heating package of claim 13, wherein the platform further includes a plurality of support elements.

19. The microwave heating package of claim 13, wherein the microwave energy interactive material of the flexible component circumscribes a plurality of microwave energy transparent areas.

20. The microwave heating package of claim 13, wherein the microwave energy interactive material of the flexible component is supported on a first polymer film, a moisture-containing layer is joined to the microwave energy interactive material of the flexible component, and a second polymer film is joined to the moisture-containing layer in a predetermined pattern, thereby defining a plurality of expandable insulating cells between the moisture-containing layer and the second polymer film, wherein the microwave energy interactive material of the flexible component is operative for heating upon sufficient impingement by microwave energy, and the expandable insulating cells are operative for inflating when the microwave heating package is sufficiently exposed to microwave energy.

21. A microwave heating package, comprising:

a dimensionally stable platform for receiving a food item, the platform including a base and a pair of walls opposite one another, the base including microwave energy interactive material; and a flexible component dimensioned to receive the platform, the flexible component comprising microwave energy interactive material supported on a first polymer film, a moisture-containing layer joined to the microwave energy interactive material supported on the first polymer film, and a second polymer film joined to the moisture-containing layer in a predetermined pattern, thereby defining a plurality of expandable insulating cells between the moisture-containing layer and the second polymer film, wherein the microwave energy interactive material of the flexible component is operative for heating upon sufficient impingement by microwave energy, and the expandable insulating cells are operative for inflating when the microwave heating package is sufficiently exposed to microwave energy, wherein the microwave energy interactive material of the base and the microwave energy interactive material of the flexible component are configured for being in a superposed configuration beneath the food item.

22. The microwave heating package of claim 21, wherein the microwave energy interactive material of the flexible component is further configured for overlying the food item.

23. The microwave heating package of claim 21, wherein the microwave energy interactive material of at least one of the base and the flexible component is operative for converting at least a portion of impinging microwave energy into thermal energy.

24. The microwave heating package of claim 21, wherein the microwave energy interactive material of the base comprises a plurality of metal foil segments.

25. The microwave heating package of claim 24, wherein the metal foil segments are arranged as a pair of substantially circular groups.

26. The microwave heating package of claim 21, wherein the microwave energy interactive material of the base comprises a plurality of metal foil segments in a superposed relationship with a susceptor.

27. The microwave heating package of claim 21, wherein the platform further includes a plurality of support elements extending downwardly from the platform.

28. The microwave heating package of claim 21, wherein the platform defines a portion of a sleeve, the sleeve further includes a top panel joined to the pair of walls opposite the base, and at least one of the top panel and walls includes microwave energy interactive material.

29. The microwave heating package of claim 28, further comprising a tear line extending around the sleeve, wherein the tear line substantially bisects the base, walls, and top panel.

30. The microwave heating package of claim 29, wherein the tear line substantially bisects the top panel into a first section and second section, the first section and the second section of the top panel each being substantially octagonal in shape.

31. The microwave heating package of claim 21, wherein the microwave energy interactive material of the flexible component circumscribes a plurality of microwave energy transparent areas.

32. A microwave heating package, comprising:

a dimensionally stable first component for receiving a food item, the first component comprising microwave energy interactive material; and a flexible second component dimensioned to receive the first component, the second component comprising microwave energy interactive material supported on a first polymer film, a moisture-containing layer joined to the microwave energy interactive material on the first polymer film, and a second polymer film joined to the moisture-containing layer in a predetermined pattern, thereby defining a plurality of expandable insulating cells between the moisture-containing layer and the second polymer film, wherein the microwave energy interactive material of the second component is operative for heating upon sufficient impingement by microwave energy, and the expandable insulating cells are operative for inflating when the microwave heating package is sufficiently exposed to microwave energy, wherein the second component includes a first panel for underlying the first component and a second panel for overlying the first component, the first panel and the second panel each comprising the microwave energy interactive material, wherein the microwave energy interactive material of the first panel of the second component and the microwave energy interactive material of the first component are configured for being in a superposed configuration beneath the food item, and the microwave energy interactive material of the second panel of the second component is configured for overlying the food item.

33. The microwave heating package of claim 32, wherein the first component comprises a substantially planar card.

34. The microwave heating package of claim 33, wherein the card includes two portions, the portions each being somewhat square in shape with rounded corners.

35. The microwave heating package of claim 32, wherein the first component comprises a tray including a base and a plurality of upstanding walls.

36. The microwave heating package of claim 32, wherein the microwave energy interactive material of at least one of the first component and the second component comprises a susceptor that is operative for absorbing at least a portion of impinging microwave energy and converting it to thermal energy.

37. The microwave heating package of claim 32, wherein the microwave energy interactive material of the first component comprises a plurality of metallic foil segments in a superposed relationship with a susceptor.

38. The microwave heating package of claim 32, wherein the microwave energy interactive material of the second component is arranged in a grid-like configuration.

* * * * *